US008056734B2

(12) United States Patent
Menz et al.

(10) Patent No.: US 8,056,734 B2
(45) Date of Patent: Nov. 15, 2011

(54) MERCHANDISING SYSTEM WITH FLIPPABLE COLUMN AND/OR ITEM STOP

(75) Inventors: Albert Menz, Douglaston, NY (US); James McKay Duncan, Brooklyn, NY (US); Stephen Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 1008 days.

(21) Appl. No.: 11/877,472

(22) Filed: Oct. 23, 2007

(65) Prior Publication Data

US 2008/0129161 A1 Jun. 5, 2008

Related U.S. Application Data

(60) Provisional application No. 60/895,345, filed on Mar. 16, 2007, provisional application No. 60/862,553, filed on Oct. 23, 2006.

(51) Int. Cl.
*A47F 7/00* (2006.01)

(52) U.S. Cl. ..... 211/59.2

(58) Field of Classification Search ..... 211/59.2, 211/168, 169, 96, 47; 312/136, 325
See application file for complete search history.

(56) References Cited

U.S. PATENT DOCUMENTS 632,231 A 9/1899 Blades
808,067 A 12/1905 Briggs
847,863 A 3/1907 Watts
887,882 A * 5/1908 Waugh ..... 211/169
1,044,381 A * 11/1912 Harr ..... 211/47
1,049,886 A * 1/1913 Manson ..... 40/497
1,156,140 A 10/1915 Hair
1,314,887 A * 9/1919 Miano ..... 211/40
1,569,365 A * 1/1926 Goldberg ..... 211/163
1,703,987 A 3/1929 Butler
1,712,080 A 5/1929 Kelly
1,734,031 A 11/1929 Carlson
1,786,392 A 12/1930 Kemp
1,964,597 A 6/1934 Rapellin
1,971,749 A 8/1934 Hamilton
1,991,102 A 2/1935 Kemaghan
2,013,284 A 9/1935 Michaud (Continued)

FOREIGN PATENT DOCUMENTS

BE 906083 4/1987

(Continued)

OTHER PUBLICATIONS

FFr Yello Pages® 2003 Product Catalog, "Merchandising Ideas Made Easy for Every Retail Environment", Cover pg., 9-11, 48-49, 52-58, Back Cover.

(Continued)

*Primary Examiner* — Sarah Purol
(74) *Attorney, Agent, or Firm* — Banner & Witcoff, Ltd.

(57) ABSTRACT

Disclosed herein is a merchandising system and method that permits access from the front of a column of shelves and along a side of the column of shelves, the shelves in each column extending from the front of the merchandizing system to a back area of the merchandising system. Each shelf can be of any suitable design for supporting products or items. The merchandising system can have at least one flippable column comprising at least one shelf suitable for supporting a single row of items. Various front item stops are also disclosed.

31 Claims, 25 Drawing Sheets

U.S. PATENT DOCUMENTS

| | | | | | |
|---|---|---|---|---|---|
| 2,057,627 | A | | 10/1936 | Ferris | |
| 2,079,754 | A | | 5/1937 | Waxgiser | |
| 2,085,479 | A | | 6/1937 | Shaffer et al. | |
| 2,110,299 | A | | 3/1938 | Hinkle | |
| 2,111,496 | A | | 3/1938 | Scriba | |
| 2,129,122 | A | | 9/1938 | Follett | |
| 2,218,444 | A | | 10/1940 | Vineyard | |
| 2,339,627 | A | * | 1/1944 | Edison | 312/199 |
| 2,499,088 | A | | 2/1950 | Brill et al. | |
| 2,516,122 | A | | 7/1950 | Hughes | |
| 2,555,102 | A | | 5/1951 | Anderson | |
| 2,652,154 | A | | 9/1953 | Stevens | |
| 2,670,853 | A | | 3/1954 | Schneider | |
| 2,678,045 | A | | 5/1954 | Erhard | |
| 2,738,881 | A | | 3/1956 | Michel | |
| 2,750,049 | A | | 6/1956 | Hunter | |
| 2,775,365 | A | | 12/1956 | Mestman et al. | |
| 2,893,596 | A | | 7/1959 | Gabrielsen | |
| 2,918,295 | A | | 12/1959 | Milner | |
| 2,934,212 | A | | 4/1960 | Jacobson | |
| 2,948,403 | A | | 8/1960 | Vallez | |
| 3,083,067 | A | | 3/1963 | Vos et al. | |
| 3,103,396 | A | | 9/1963 | Portnoy | |
| 3,110,402 | A | | 11/1963 | Mogulescu | |
| 3,151,576 | A | | 10/1964 | Patterson | |
| 3,161,295 | A | | 12/1964 | Chesley | |
| 3,166,195 | A | | 1/1965 | Taber | |
| 3,285,429 | A | | 11/1966 | Propst | |
| 3,308,961 | A | | 3/1967 | Chesley | |
| 3,308,964 | A | | 3/1967 | Pistone | |
| 3,348,732 | A | | 10/1967 | Schwarz | |
| 3,405,716 | A | | 10/1968 | Cafiero et al. | |
| 3,452,899 | A | | 7/1969 | Libberton | |
| D219,058 | S | | 10/1970 | Kaczur | |
| 3,550,979 | A | | 12/1970 | Protzmann | |
| 3,556,620 | A | * | 1/1971 | Gutierrez | 312/136 |
| 3,598,246 | A | | 8/1971 | Galli | |
| 3,652,154 | A | | 3/1972 | Gebel | |
| 3,667,826 | A | | 6/1972 | Wood et al. | |
| 3,698,568 | A | | 10/1972 | Armstrong | |
| 3,709,371 | A | | 1/1973 | Luck | |
| 3,751,129 | A | | 8/1973 | Wright et al. | |
| 3,760,952 | A | * | 9/1973 | White | 211/168 |
| 3,777,896 | A | * | 12/1973 | Ehrlich | 211/59.2 |
| 3,814,490 | A | | 6/1974 | Dean et al. | |
| 3,815,519 | A | | 6/1974 | Meyer | |
| 3,830,169 | A | | 8/1974 | Madey | |
| 3,848,745 | A | | 11/1974 | Smith | |
| 3,868,021 | A | | 2/1975 | Heinrich | |
| 3,870,156 | A | | 3/1975 | O'Neill | |
| 3,924,749 | A | * | 12/1975 | Weston | 211/4 |
| 3,960,273 | A | * | 6/1976 | Weston | 211/4 |
| 4,007,841 | A | | 2/1977 | Seipel | |
| 4,042,096 | A | | 8/1977 | Smith | |
| 4,106,668 | A | | 8/1978 | Gebhardt et al. | |
| 4,269,326 | A | | 5/1981 | Delbrouck | |
| D260,466 | S | * | 9/1981 | Butcher et al. | D6/410 |
| 4,300,693 | A | | 11/1981 | Spamer | |
| 4,303,162 | A | | 12/1981 | Suttles | |
| 4,331,243 | A | | 5/1982 | Doll | |
| 4,339,164 | A | * | 7/1982 | Spevak | 312/283 |
| 4,351,439 | A | | 9/1982 | Taylor | |
| 4,378,872 | A | | 4/1983 | Brown | |
| 4,397,606 | A | | 8/1983 | Bruton | |
| 4,416,380 | A | | 11/1983 | Flum | |
| 4,448,653 | A | | 5/1984 | Wegmann | |
| 4,454,948 | A | | 6/1984 | Spamer | |
| 4,454,949 | A | | 6/1984 | Flum | |
| 4,460,096 | A | | 7/1984 | Ricci | |
| D275,058 | S | | 8/1984 | Flum | |
| 4,463,854 | A | | 8/1984 | MacKenzie | |
| 4,467,927 | A | | 8/1984 | Nathan | |
| 4,470,943 | A | | 9/1984 | Preis | |
| 4,478,337 | A | | 10/1984 | Flum | |
| 4,482,066 | A | | 11/1984 | Dykstra | |
| 4,488,653 | A | | 12/1984 | Belokin | |
| 4,504,100 | A | | 3/1985 | Chaumard | |
| 4,569,448 | A | * | 2/1986 | Graham | 211/74 |
| 4,588,093 | A | | 5/1986 | Field | |
| 4,589,349 | A | | 5/1986 | Gebhardt et al. | |
| 4,590,696 | A | | 5/1986 | Squitieri | |
| 4,593,823 | A | | 6/1986 | Fershko et al. | |
| 4,602,560 | A | | 7/1986 | Jacky | |
| 4,615,276 | A | | 10/1986 | Garabedian | |
| 4,620,489 | A | | 11/1986 | Albano | |
| 4,629,072 | A | | 12/1986 | Loew | |
| 4,651,883 | A | | 3/1987 | Gullett et al. | |
| 4,678,086 | A | * | 7/1987 | Nervig et al. | 211/47 |
| 4,685,574 | A | | 8/1987 | Young et al. | |
| 4,705,175 | A | | 11/1987 | Howard et al. | |
| 4,706,821 | A | | 11/1987 | Kohls et al. | |
| 4,724,968 | A | | 2/1988 | Wombacher | |
| 4,729,481 | A | | 3/1988 | Hawkinson et al. | |
| 4,730,741 | A | | 3/1988 | Jackle, III et al. | |
| 4,742,936 | A | | 5/1988 | Rein | |
| 4,762,236 | A | | 8/1988 | Jackle, III et al. | |
| 4,771,898 | A | | 9/1988 | Howard et al. | |
| 4,775,058 | A | | 10/1988 | Yatsko | |
| 4,776,472 | A | | 10/1988 | Rosen | |
| 4,801,025 | A | | 1/1989 | Flum et al. | |
| 4,809,855 | A | | 3/1989 | Bustos | |
| 4,828,144 | A | | 5/1989 | Garrick | |
| 4,830,201 | A | | 5/1989 | Breslow | |
| 4,836,390 | A | | 6/1989 | Polvere | |
| 4,846,367 | A | | 7/1989 | Guigan et al. | |
| 4,883,169 | A | | 11/1989 | Flanagan, Jr. | |
| 4,887,737 | A | | 12/1989 | Adenau | |
| 4,899,668 | A | | 2/1990 | Valiulis | |
| 4,899,893 | A | | 2/1990 | Robertson | |
| 4,901,853 | A | | 2/1990 | Maryatt | |
| 4,907,707 | A | | 3/1990 | Crum | |
| 4,913,297 | A | * | 4/1990 | Wells | 211/96 |
| 4,923,070 | A | | 5/1990 | Jackle et al. | |
| 4,934,645 | A | | 6/1990 | Breslow | |
| 4,958,739 | A | | 9/1990 | Spamer | |
| RE33,515 | E | | 1/1991 | Fershko et al. | |
| 4,997,094 | A | | 3/1991 | Spamer et al. | |
| 5,012,936 | A | | 5/1991 | Crum | |
| 5,024,336 | A | | 6/1991 | Spamer | |
| 5,025,936 | A | | 6/1991 | Lamoureaux | |
| 5,027,957 | A | | 7/1991 | Skalski | |
| 5,082,125 | A | | 1/1992 | Ninni | |
| 5,088,607 | A | | 2/1992 | Risafi et al. | |
| 5,110,192 | A | | 5/1992 | Lauterbach | |
| 5,111,942 | A | | 5/1992 | Bernardin | |
| 5,123,546 | A | | 6/1992 | Crum | |
| 5,139,155 | A | * | 8/1992 | Laxson | 211/169 |
| 5,148,927 | A | | 9/1992 | Gebka | |
| 5,159,753 | A | | 11/1992 | Torrence | |
| 5,160,050 | A | * | 11/1992 | Russo | 211/40 |
| 5,161,702 | A | | 11/1992 | Skalski | |
| 5,178,258 | A | | 1/1993 | Smalley | |
| 5,183,166 | A | | 2/1993 | Belokin, Jr. et al. | |
| 5,190,186 | A | | 3/1993 | Yablans et al. | |
| 5,197,610 | A | | 3/1993 | Bustos | |
| 5,203,463 | A | | 4/1993 | Gold | |
| 5,215,199 | A | | 6/1993 | Bejarano | |
| D337,676 | S | * | 7/1993 | Hardy | D6/491 |
| 5,226,548 | A | * | 7/1993 | Koeppel | 211/144 |
| 5,255,802 | A | | 10/1993 | Krinke et al. | |
| 5,259,517 | A | * | 11/1993 | Pancoe | 211/46 |
| 5,265,738 | A | | 11/1993 | Yablans et al. | |
| 5,295,596 | A | | 3/1994 | Squitieri | |
| 5,316,154 | A | | 5/1994 | Hajec, Jr. | |
| 5,341,945 | A | | 8/1994 | Gibson | |
| 5,351,839 | A | | 10/1994 | Beeler et al. | |
| 5,366,099 | A | | 11/1994 | Schmid | |
| 5,390,802 | A | | 2/1995 | Pappagallo et al. | |
| 5,397,016 | A | | 3/1995 | Torrence et al. | |
| 5,405,193 | A | * | 4/1995 | Herrenbruck | 312/118 |
| 5,415,296 | A | * | 5/1995 | Wright | 211/40 |
| 5,415,297 | A | | 5/1995 | Klein et al. | |
| 5,439,122 | A | | 8/1995 | Ramsay | |
| 5,450,969 | A | | 9/1995 | Johnson et al. | |
| 5,452,809 | A | * | 9/1995 | Capel | 211/47 |
| 5,458,248 | A | | 10/1995 | Alain | |
| 5,464,105 | A | | 11/1995 | Mandeltort | |

5,469,976 A 11/1995 Burchell
5,505,315 A 4/1996 Carroll
5,542,552 A 8/1996 Yablans et al.
5,562,217 A 10/1996 Salveson et al.
5,588,537 A * 12/1996 Hagopian ..... 211/4
5,597,150 A 1/1997 Stein et al.
5,613,621 A 3/1997 Gervasi
D378,888 S 4/1997 Bertilsson
5,615,780 A 4/1997 Nimetz et al.
5,634,564 A 6/1997 Spamer et al.
5,641,082 A 6/1997 Grainger
5,645,176 A 7/1997 Jay
5,649,631 A * 7/1997 Loflin ..... 211/44
5,665,304 A 9/1997 Heinen et al.
5,673,801 A 10/1997 Markson
D386,363 S 11/1997 Dardashti
5,685,664 A 11/1997 Parham et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,910 A * 4/1998 Ueng ..... 206/373
5,740,944 A 4/1998 Crawford
5,746,328 A 5/1998 Beeler et al.
5,749,478 A 5/1998 Ellis
5,782,366 A * 7/1998 Garza, Jr. ..... 211/41.12
5,826,731 A 10/1998 Dardashti
5,839,588 A 11/1998 Hawkinson
D402,490 S 12/1998 Parham
5,855,283 A 1/1999 Johnson
5,865,324 A 2/1999 Jay et al.
5,873,473 A 2/1999 Pater
5,873,489 A 2/1999 Ide et al.
5,878,895 A 3/1999 Springs
5,887,732 A 3/1999 Zimmer et al.
5,899,343 A * 5/1999 Franklin et al. ..... 211/85.2
5,904,256 A 5/1999 Jay
5,906,283 A 5/1999 Kump et al.
5,927,544 A * 7/1999 Kanoh et al. ..... 221/90
5,944,201 A 8/1999 Babboni et al.
5,970,887 A 10/1999 Hardy
5,971,204 A 10/1999 Apps
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,041,720 A 3/2000 Hardy
6,068,142 A 5/2000 Primiano
6,082,556 A 7/2000 Primiano et al.
6,082,557 A 7/2000 Leahy
6,102,502 A * 8/2000 Melillo et al. ..... 312/234
6,112,938 A 9/2000 Apps
6,129,218 A 10/2000 Henry et al.
6,142,317 A 11/2000 Merl
6,164,462 A 12/2000 Mumford
6,164,491 A 12/2000 Bustos et al.
6,173,845 B1 1/2001 Higgins et al.
6,209,731 B1 4/2001 Spamer et al.
6,209,733 B1 4/2001 Higgins et al.
6,227,385 B1 5/2001 Nickerson
6,234,325 B1 5/2001 Higgins et al.
6,234,326 B1 5/2001 Higgins et al.
6,234,328 B1 5/2001 Mason
D445,615 S 7/2001 Burke
6,253,954 B1 7/2001 Yasaka
6,260,296 B1 * 7/2001 Carney, Jr. ..... 40/747
6,286,692 B1 * 9/2001 Hemping ..... 211/169
6,311,852 B1 11/2001 Ireland
6,325,221 B2 12/2001 Parham
6,330,758 B1 12/2001 Feibelman
6,340,092 B1 * 1/2002 McGrath, Jr. ..... 211/169
6,357,606 B1 3/2002 Henry
6,375,015 B1 4/2002 Wingate
6,382,431 B1 5/2002 Burke
6,394,291 B2 * 5/2002 Maier-Hunke ..... 211/169
6,398,044 B1 6/2002 Robertson
6,401,942 B1 6/2002 Eckert
6,405,880 B1 6/2002 Webb
6,409,027 B1 6/2002 Chang et al.
6,409,028 B2 6/2002 Nickerson
6,419,100 B1 7/2002 Menz et al.
6,428,123 B1 8/2002 Lucht et al.
6,435,359 B1 8/2002 Priminano
6,439,402 B2 8/2002 Robertson
6,464,089 B1 10/2002 Rankin, VI
6,471,053 B1 10/2002 Feibelman
6,484,891 B2 11/2002 Burke
6,497,326 B1 12/2002 Osawa
6,505,747 B1 1/2003 Robertson
6,523,702 B1 2/2003 Primiano et al.
6,523,703 B1 2/2003 Robertson
6,527,127 B2 3/2003 Dumontet
6,533,131 B2 3/2003 Bada
D472,411 S 4/2003 Burke
6,547,087 B2 * 4/2003 Accatino ..... 211/169
6,554,143 B1 4/2003 Robertson
6,604,638 B1 8/2003 Primiano et al.
6,615,995 B2 9/2003 Primiano et al.
6,619,767 B2 * 9/2003 Conway ..... 312/234
6,622,874 B1 9/2003 Hawkinson
6,637,604 B1 10/2003 Jay
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 1/2004 Robertson et al.
6,695,152 B1 2/2004 Fabrizio et al.
6,715,621 B2 4/2004 Boron
6,722,509 B1 4/2004 Robertson et al.
6,745,905 B2 6/2004 Bernstein
6,756,975 B1 6/2004 Kishida et al.
6,758,349 B1 7/2004 Kwap et al.
6,772,888 B2 8/2004 Burke
6,779,670 B2 8/2004 Primiano et al.
6,799,523 B1 10/2004 Cunha
6,811,046 B2 * 11/2004 Stein ..... 211/169
6,843,382 B2 1/2005 Kanouchi et al.
6,860,046 B1 3/2005 Squitieri
6,866,156 B2 3/2005 Nagel et al.
6,867,824 B2 3/2005 Eiraku et al.
6,874,646 B2 4/2005 Jay
6,889,855 B2 5/2005 Nagel
6,902,285 B2 6/2005 Eiraku et al.
6,918,736 B2 7/2005 Hart et al.
6,919,933 B2 7/2005 Zhang et al.
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh et al.
7,028,450 B2 4/2006 Hart et al.
7,080,969 B2 7/2006 Hart et al.
7,083,054 B2 8/2006 Squitieri
7,086,541 B2 8/2006 Robertson
7,093,546 B2 8/2006 Hardy
7,104,026 B2 9/2006 Welborn et al.
7,108,143 B1 9/2006 Lin
7,140,499 B2 11/2006 Burke
7,150,365 B2 12/2006 Hardy et al.
7,152,536 B2 12/2006 Hardy
7,168,579 B2 1/2007 Richter et al.
7,182,209 B2 2/2007 Squitieri
7,195,123 B2 3/2007 Roslof et al.
7,201,281 B1 4/2007 Welker
7,216,770 B2 5/2007 Mueller
7,293,663 B2 11/2007 Lavery, Jr.
7,299,934 B2 11/2007 Hardy et al.

| | | | | |
|---|---|---|---|---|
| 7,395,938 | B2 | 7/2008 | Merit et al. | |
| 7,451,881 | B2 | 11/2008 | Hardy et al. | |
| 7,458,473 | B1 | 12/2008 | Mason | |
| 7,624,880 | B2 * | 12/2009 | Kin et al. | 211/45 |
| 2001/0010302 | A1 | 8/2001 | Nickerson | |
| 2001/0019032 | A1 | 9/2001 | Battaglia et al. | |
| 2001/0042706 | A1 | 11/2001 | Ryan, Jr. et al. | |
| 2001/0045403 | A1 | 11/2001 | Robertson | |
| 2002/0036178 | A1 | 3/2002 | Tombu | |
| 2002/0066706 | A1 | 6/2002 | Robertson | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2002/0179553 | A1 | 12/2002 | Squitieri | |
| 2002/0182050 | A1 | 12/2002 | Hart et al. | |
| 2002/0189201 | A1 | 12/2002 | Hart et al. | |
| 2002/0189209 | A1 | 12/2002 | Hart et al. | |
| 2003/0000956 | A1 | 1/2003 | Maldonado | |
| 2003/0007859 | A1 | 1/2003 | Hart et al. | |
| 2003/0010732 | A1 | 1/2003 | Burke | |
| 2003/0057167 | A1 | 3/2003 | Johnson et al. | |
| 2003/0061973 | A1 | 4/2003 | Bustos | |
| 2003/0080075 | A1 | 5/2003 | Primiano et al. | |
| 2003/0085187 | A1 | 5/2003 | Johnson et al. | |
| 2003/0132178 | A1 | 7/2003 | Jay et al. | |
| 2003/0132182 | A1 | 7/2003 | Jay | |
| 2003/0136750 | A1 | 7/2003 | Fujii et al. | |
| 2003/0141265 | A1 | 7/2003 | Jo et al. | |
| 2003/0168420 | A1 | 9/2003 | Primiano | |
| 2003/0217980 | A1 | 11/2003 | Johnson et al. | |
| 2004/0000528 | A1 | 1/2004 | Nagel | |
| 2004/0004046 | A1 | 1/2004 | Primiano et al. | |
| 2004/0079715 | A1 | 4/2004 | Richter et al. | |
| 2004/0084390 | A1 | 5/2004 | Bernstein | |
| 2004/0094493 | A1 | 5/2004 | Higgins | |
| 2004/0104239 | A1 | 6/2004 | Black, Jr. et al. | |
| 2004/0140278 | A1 | 7/2004 | Mueller et al. | |
| 2004/0140279 | A1 | 7/2004 | Mueller et al. | |
| 2004/0182805 | A1 | 9/2004 | Harper | |
| 2004/0206054 | A1 | 10/2004 | Welborn et al. | |
| 2004/0232092 | A1 | 11/2004 | Cash | |
| 2004/0245197 | A1 | 12/2004 | McElvaney | |
| 2005/0040123 | A1 | 2/2005 | Ali | |
| 2005/0072747 | A1 | 4/2005 | Roslof et al. | |
| 2005/0076817 | A1 | 4/2005 | Boks et al. | |
| 2005/0098515 | A1 | 5/2005 | Close | |
| 2005/0127014 | A1 | 6/2005 | Richter et al. | |
| 2005/0133471 | A1 | 6/2005 | Squitieri | |
| 2005/0199563 | A1 | 9/2005 | Richter et al. | |
| 2005/0199564 | A1 | 9/2005 | Johnson et al. | |
| 2005/0199565 | A1 | 9/2005 | Richter et al. | |
| 2005/0249577 | A1 | 11/2005 | Hart et al. | |
| 2005/0263465 | A1 | 12/2005 | Chung | |
| 2006/0001337 | A1 | 1/2006 | Walburn | |
| 2006/0032827 | A1 | 2/2006 | Phoy | |
| 2006/0049122 | A1 | 3/2006 | Mueller et al. | |
| 2006/0104758 | A1 | 5/2006 | Hart et al. | |
| 2006/0163272 | A1 | 7/2006 | Gamble | |
| 2006/0186064 | A1 | 8/2006 | Merit et al. | |
| 2006/0186066 | A1 | 8/2006 | Johnson et al. | |
| 2006/0196840 | A1 | 9/2006 | Jay et al. | |
| 2006/0213852 | A1 | 9/2006 | Kwon | |
| 2006/0226095 | A1 | 10/2006 | Hardy | |
| 2006/0237381 | A1 | 10/2006 | Lockwood et al. | |
| 2006/0263192 | A1 | 11/2006 | Hart et al. | |
| 2006/0273053 | A1 | 12/2006 | Roslof et al. | |
| 2006/0283150 | A1 | 12/2006 | Hart et al. | |
| 2006/0283151 | A1 | 12/2006 | Welborn et al. | |
| 2007/0170127 | A1 | 7/2007 | Johnson | |
| 2007/0175839 | A1 | 8/2007 | Schneider et al. | |
| 2007/0175844 | A1 | 8/2007 | Schneider | |

FOREIGN PATENT DOCUMENTS

| | | | |
|---|---|---|---|
| BE | 1013877 | | 11/2002 |
| BE | 1013877 | A6 | 11/2002 |
| CH | 412 251 | | 4/1966 |
| CH | 412251 | | 4/1966 |
| DE | 969003 | | 4/1958 |
| DE | 1819158 | | 7/1960 |
| DE | 2002720 | | 7/1971 |
| DE | 28 25 724 | A1 | 12/1979 |
| DE | 2825724 | A1 | 12/1979 |
| DE | 8308485 | | 9/1983 |
| DE | 8426651 | | 7/1985 |
| DE | 9300431 | U1 | 3/1993 |
| DE | 9300431.1 | | 4/1993 |
| DE | 29618870 | U1 | 12/1996 |
| DE | 29618870 | U1 | 1/1997 |
| DE | 299 02 688 | | 7/1999 |
| DE | 29902688 | | 7/1999 |
| DE | 7311113 | | 2/2009 |
| EP | 0004921 | | 4/1979 |
| EP | 0004921 | A1 | 4/1979 |
| EP | 0018003 | | 7/1984 |
| EP | 0176209 | | 4/1986 |
| EP | 0224107 | A2 | 11/1986 |
| EP | 270016 | | 6/1988 |
| EP | 0 337 340 | | 10/1989 |
| EP | 0337340 | | 10/1989 |
| EP | 0408400 | A1 | 7/1990 |
| EP | 0 398 500 | A1 | 11/1990 |
| EP | 0398500 | A1 | 11/1990 |
| EP | 0 454 586 | B1 | 10/1991 |
| EP | 0454586 | B1 | 10/1991 |
| EP | 0568396 | A1 | 5/1993 |
| EP | 0568396 | A1 | 11/1993 |
| EP | 0587059 | A2 | 3/1994 |
| EP | 986980 | | 3/2000 |
| EP | 0 779 047 | B1 | 4/2000 |
| EP | 0779047 | B1 | 4/2000 |
| EP | 1395152 | | 2/2005 |
| EP | 1857021 | A1 | 11/2007 |
| FR | 2 385 365 | | 10/1978 |
| FR | 2385365 | | 10/1978 |
| FR | 2526338 | | 11/1983 |
| FR | 2617385 | | 1/1989 |
| GB | 740311 | | 11/1955 |
| GB | 881 700 | | 11/1961 |
| GB | 881700 | | 11/1961 |
| GB | 2 027339 | A | 2/1980 |
| GB | 2027339 | A | 2/1980 |
| GB | 2037553 | | 7/1980 |
| GB | 2281289 | | 1/1995 |
| GB | 2 283 407 | A | 5/1995 |
| GB | 2283407 | A | 5/1995 |
| GB | 2290077 | | 12/1995 |
| GB | 2297241 | A | 7/1996 |
| GB | 2392667 | A | 3/2004 |
| GB | 1088654 | | 4/2008 |
| JP | 54168195 | | 11/1979 |
| JP | 59 218113 | | 8/1984 |
| JP | 62060521 | A | 3/1987 |
| JP | 6329463 | | 2/1988 |
| JP | 02-191413 | | 7/1990 |
| JP | 6202945 | | 7/1994 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| NL | 106617 | | 11/1963 |
| NL | 8520125 | | 1/1986 |
| NL | 1018330 | | 6/2001 |
| NL | 1018330 | | 7/2002 |
| SE | 394537 | | 6/1977 |
| SU | 1600615 | A3 | 6/1987 |
| SU | 1600615 | | 10/1990 |
| WO | 91/15141 | A | 10/1991 |
| WO | 9115141 | A | 10/1991 |
| WO | 9201614 | | 2/1992 |
| WO | 0071004 | | 11/2000 |
| WO | 02/091885 | | 11/2002 |
| WO | 02091885 | | 11/2002 |
| WO | 03/032775 | | 4/2003 |
| WO | 03032775 | A2 | 4/2003 |
| WO | 2004105556 | A | 12/2004 |
| WO | 2006094058 | | 8/2006 |

OTHER PUBLICATIONS

*RTC Ind* v. *William Merit & Assoc.*, United States District Court Northern District of Illinois (Chicago), Case #:1:04-cv-01254.
*RTC Ind* v. *Fasteners for Retail, et al.*, United States District Court Northern District of Illinois (Chicago), Case #:1:03-cv-03137.
*RTC Ind* v. *HMG Worldwide Corp.*, United States District Court Northern District of Illinois (Chicago), Case #:1:00-cv-03300.
*RTC Ind* v. *Display Specialties*, United States District Court Northern District of Illinois (Chicago), Case #:1:04-cv-03370.
*RTC Ind* v. *Semasys Inc., et al.*, United States District Court Northern District of Illinois (Chicago), Case #:1:04-cv-04081.
*RTC Ind* v. *Fasteners for Retail, et al.*, United States District Court Northern District of Illinois (Chicago), Case #:1:05-cv-06940.
*VIDPRO International Inc.* v. *RTC Industries, Inc.*, U.S. District Court Northern District of Texas (Dallas), Case #:3:95-cv-01055-G.
Supplementary European Search Report dated Jun. 18, 2009.
International Search Report dated Aug. 27, 2008.
*RTC Industries, Inc.*, v. *Fasteners for Retail, Inc.*, and *SuperValu, Inc. d/b/a Cub Foods*, Stipulation of Dismissal, Civil Action No. 05 C 6940, Apr. 2006.
*RTC* vs. *Fasteners for Retail*, Case No. 05C 6940, Document No. 26, filed Apr. 25, 2006.
*RTC Industries, Inc.*, v. *HMG Worldwide Corporation*, Complaint, Civil Action No. 00C 3300, dated May 31, 2000.
*RTC Industries, Inc.* v. *HMG Worldwide Corporation*, Amended Complaint, dated Jan. 19, 2001.
*RTC Industries, Inc.* v. *HMG Worldwide Corporation*, RTC's Reply to HMG Worldwide Corporation's Amended Counterclaims, Civil Action No. 00 Cv 3300, dated Mar. 7, 2001.
*RTC Industries, Inc.*, v. *HMG Fasteners for Retail, Inc.*, and *SuperValu, Inc. d/b/a Cub Foods*, Complaint, Civil Action No. 05C 6940.
*RTC Industries, Inc.* v. *HMG Worldwide Corporation*, Notice of Motion, Civil Action No. 00 Civ. 3300 (JHL), dated Feb. 22, 2001.
*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.
*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.
*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.
*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc.*, and *CVS Corporation*, Amended Complaint, Civil Action No. 03C 3137, dated Aug. 6, 2003.
*RTC Industries, Inc.* v. *Semasys, Inc.*, and *Uni-Sun, Inc.*, Complaint, Civil Action No. 04C 4081, dated Jun. 17, 2004.
*RTC Industries, Inc.* v. *Display Specialties, Inc.*, Complaint, Civil Action No. 04C 3370, dated May 12, 2004.
*RTC Industries, Inc.* v. *William Merit & Associates, Inc.*, Complaint, Civil Action No. 04C 1254, dated Feb. 18, 2004.
*RTC Industries, Inc.* v. *William Merit & Associates, Inc.*, Defendant's Notice of Motion for Partial Summary Judgment of Non-Infringement that Claims 1-8 of U.S. Patent No. 4,830,201 are Not Infringed, Civil Action No. 04C 1254, dated Apr. 29, 2004.
*RTC Industries, Inc.*, v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.
*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.
*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.
*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Industries, Inc.*, v. *William Merit & Associates, Inc.*, Memorandum Opinion, Civil Action No. 04 C 1254, dated Jul. 15, 2004.
*RTC Industries, Inc.* v. *Fasteners for Retail Inc.*, and *CVS Corporation*, Reply, Civil Action No. 03C 3137, dated Sep. 17, 2003.
*RTC Industries, Inc.* v. *Fasteners for Retail, Inc.*, and *CVS Pharmacy, Inc.*, to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc.*, and *CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc.*, and *CVS Pharmacy, Inc.*, to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc.*, and *CVS Pharmacy, Inc.* to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc.*, and *CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc.*, and *CVS Corporation*, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc.*, and *CVS Pharmacy, Inc.*, Defendants' Opposition to Plaintiff's Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc.*, and *CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.

*RTC Ind. Inc.* v. *Fasteners for Retail*, Minute Order of Dec. 12, 2003 by Honorable Joan B. Gottschall, Case No. 1:03-cv-03137.

*RTC Industries, Inc.,* v. *William Merit & Associates, Inc*., RTC Industries, Inc.'s Response to William Merit & Associates Statement under Local Rule 56.1 of Material Facts to Which There is no Genuine Issue and Statement of Additional Facts that Require the Denial of Summary Judgment, Civil Action No. 04 C 1254, dated Jun. 18, 2004.

*RTC Industries, Inc.,* v. *William Merit & Associates, Inc*., Index of Exhibits, Civil Action No. 04 C 1254, dated Jun. 18, 2004.

International Search Report mailed Aug. 5, 2010.

International Search Report for PCT/US2007/082270, dated Jul. 7, 2008, pp. 1-2.

* cited by examiner

FIG.30A
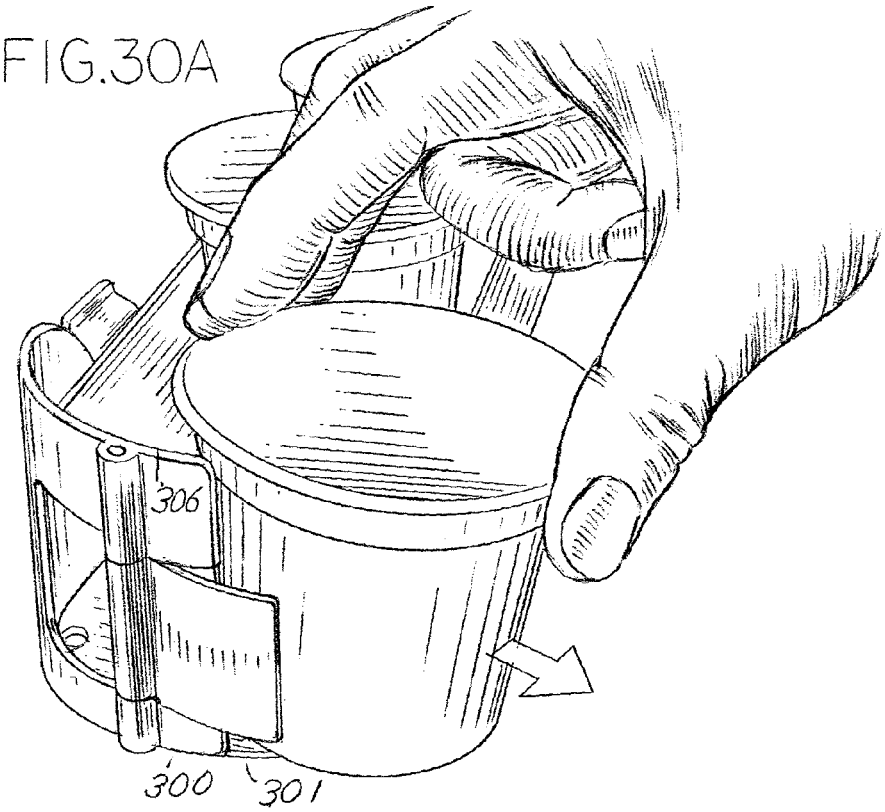
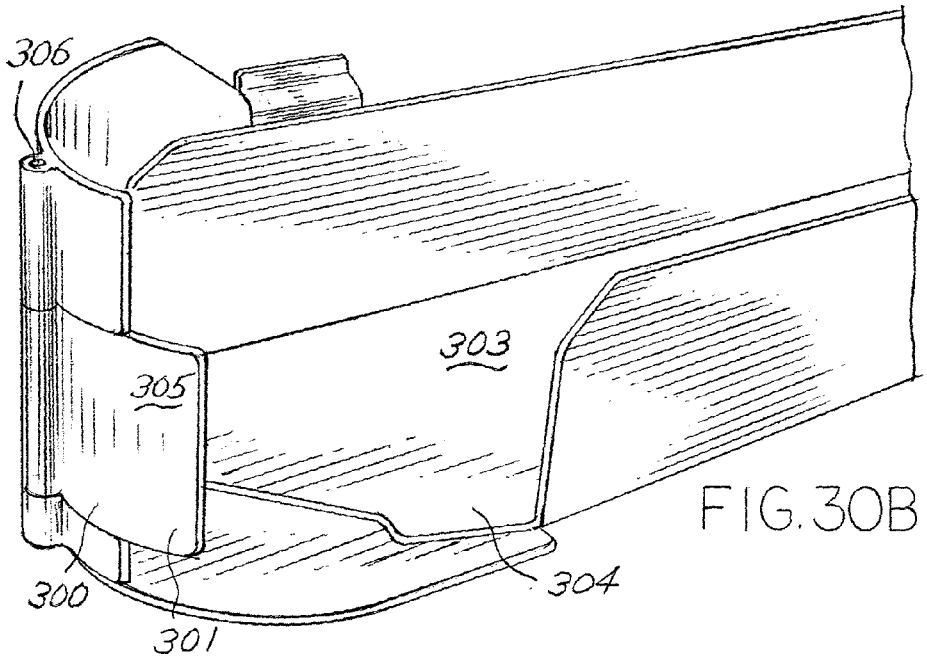
FIG.30B

FIG. 32D
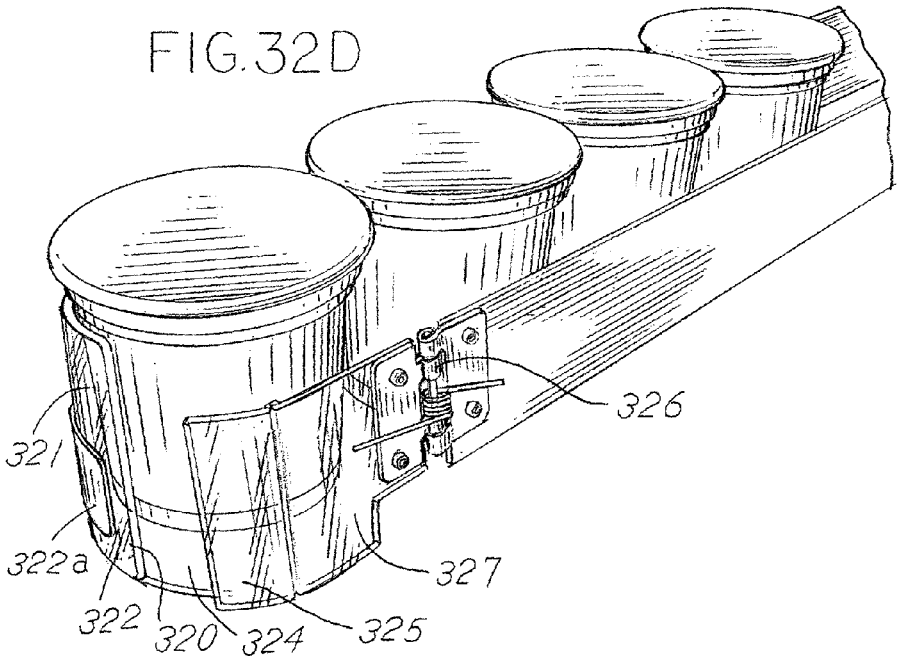
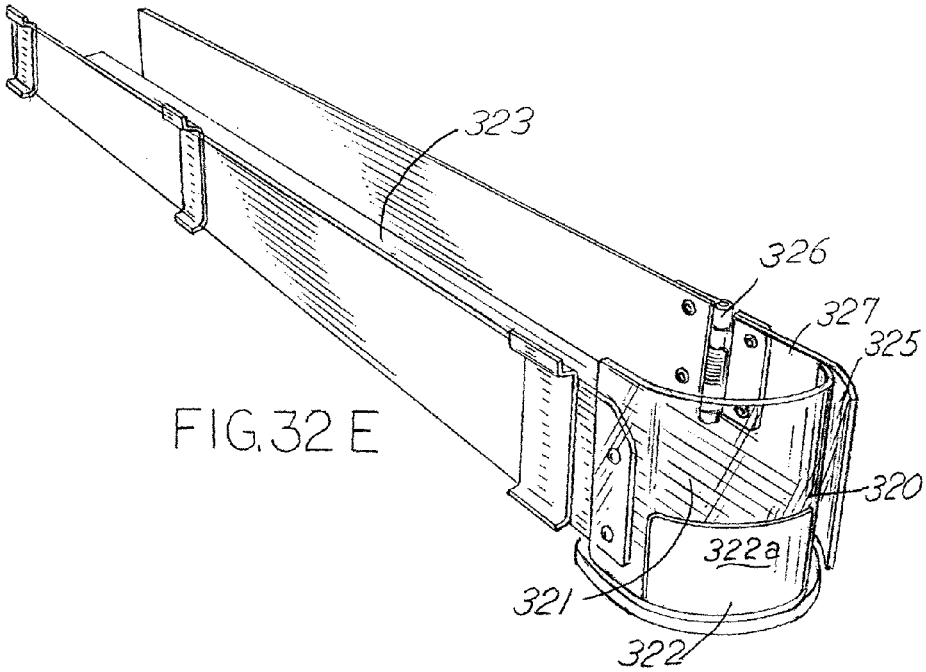
FIG. 32E

FIG.33A
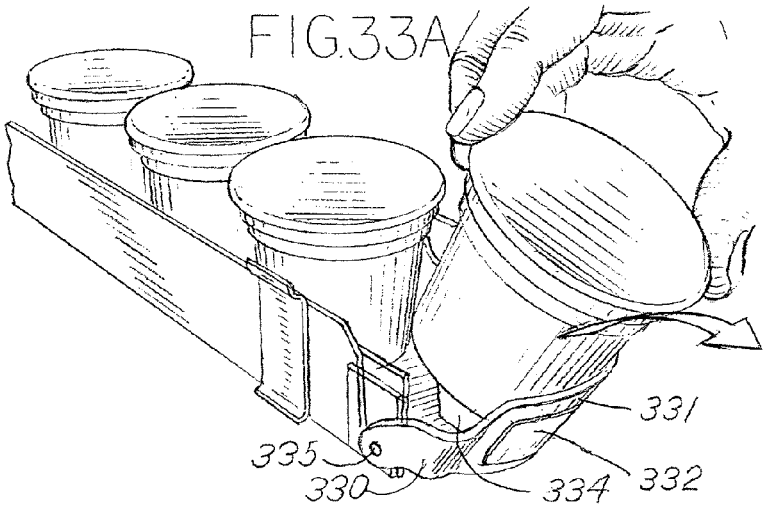
FIG.33B
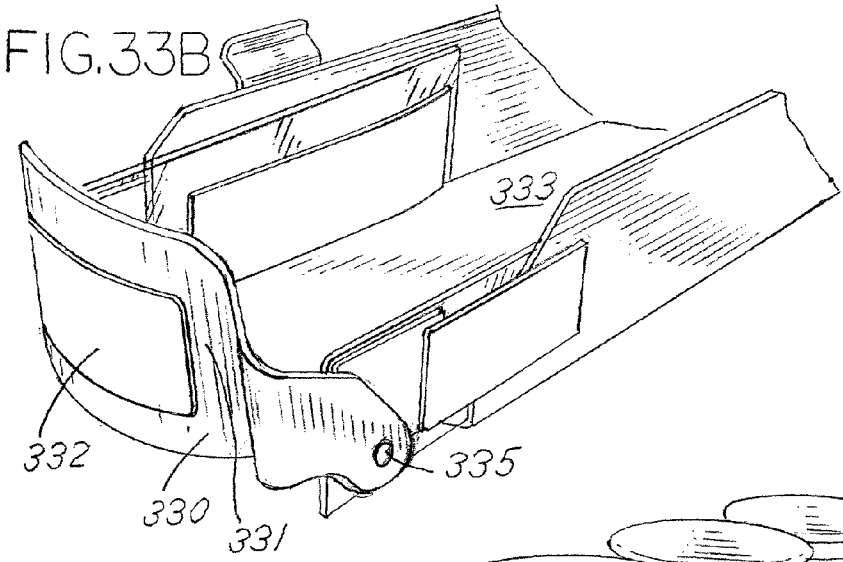
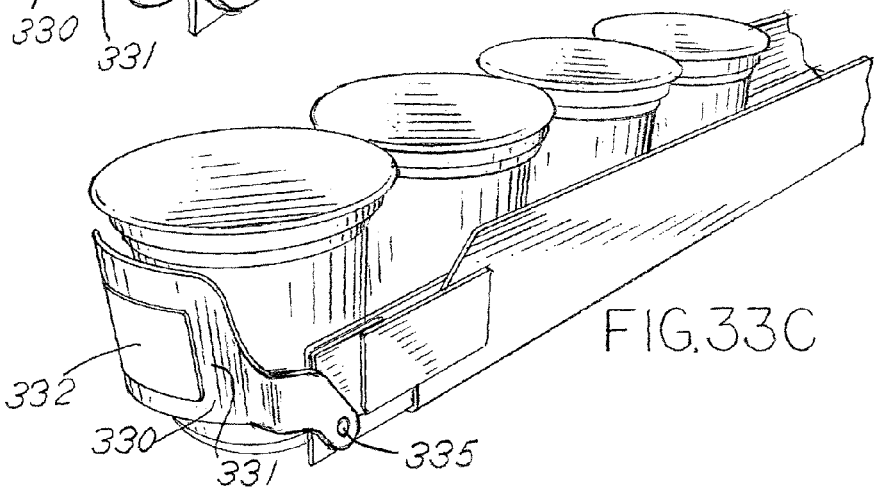
FIG.33C

FIG.34A
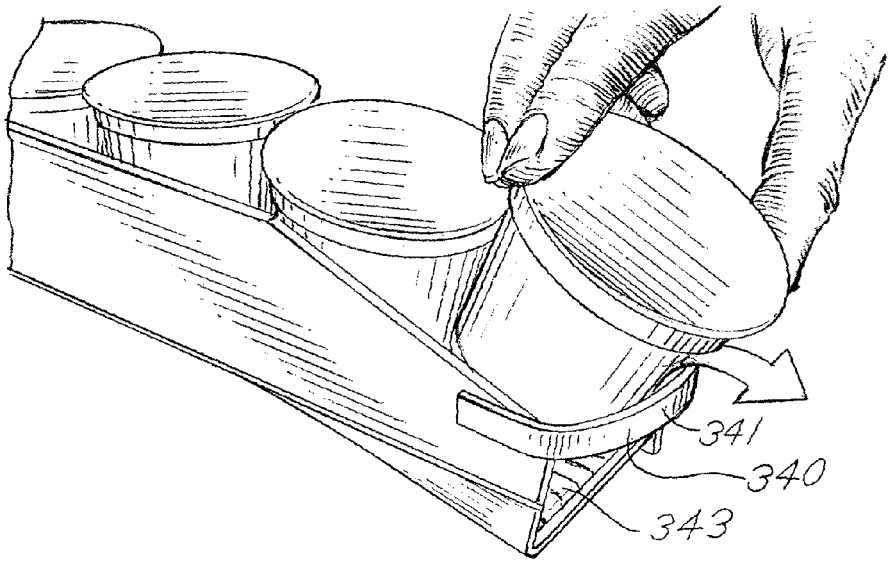
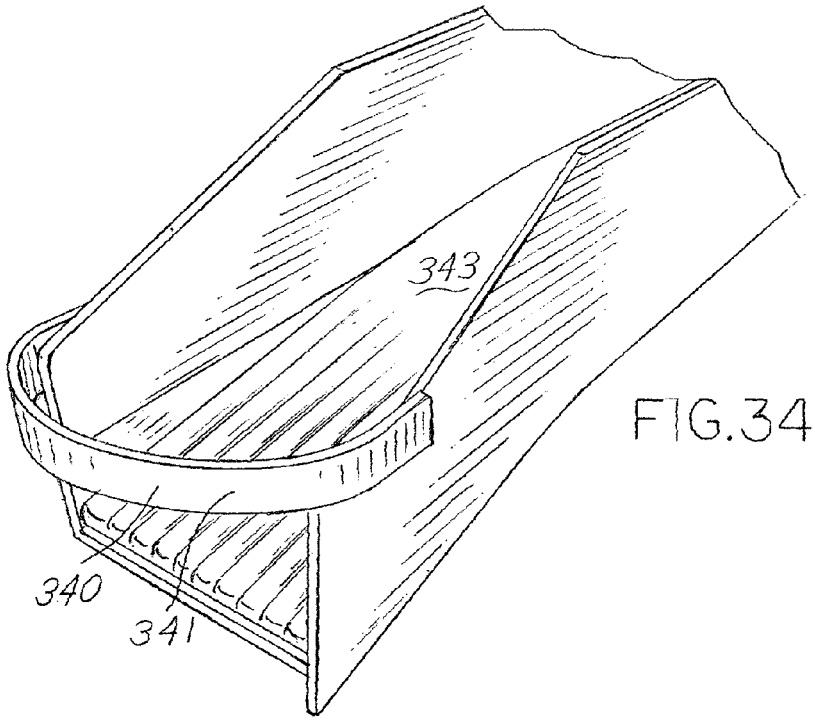
FIG.34B

FIG. 34C
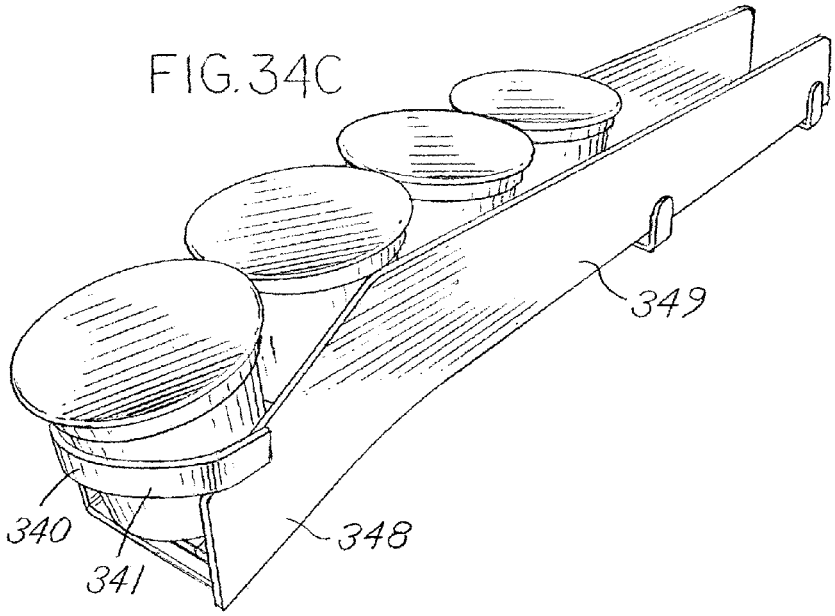
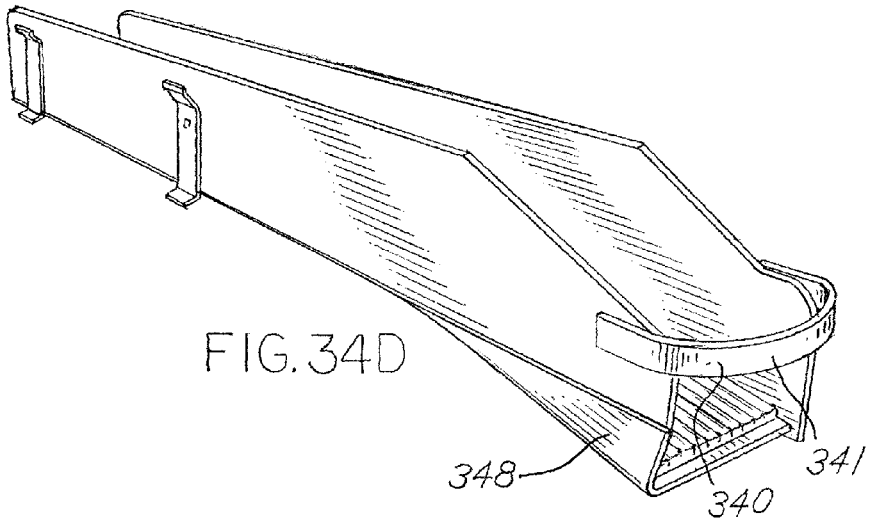
FIG. 34D

MERCHANDISING SYSTEM WITH FLIPPABLE COLUMN AND/OR ITEM STOP

FIELD OF THE INVENTION

This disclosure relates to merchandising systems.

BACKGROUND OF THE INVENTION

Retail store locations, such as grocery stores, drug stores, discount stores, and convenience stores, typically use shelving both to store and display items, such as yogurt. It is preferable that shelving be capable of organizing and displaying a large number of items.

BRIEF SUMMARY OF THE INVENTION

Disclosed herein is a merchandising system and method that permits access from the front of a column of rows or shelves and along a side of the column of rows or shelves. The shelves in each column extend from the front of the merchandizing system to a back area of the merchandising system. Each shelf can be of any suitable design to support products or items. The merchandising system can have at least one flippable column comprising at least one shelf for supporting a single row of items extending from the front to the back area of the merchandising system.

The flippable column can have a display position wherein a person positioned in front of the merchandising system can view products displayed in the front of each row of the flippable column and access such products, but cannot readily view the length of a side of the column and cannot readily access the back area of each row of the flippable column. The flippable column can be flipped to a stock position wherein a person positioned in front of the merchandising system can view products displayed in the front of each row of the flippable column, and can also view the length of a side of the column, and access the back area of each row of the flippable column. When the flippable column is in the stock position, a person positioned in front of the merchandising system can readily add products to the back area of each row or shelf as desired. After the rows or shelves in the flippable column have been stocked as desired, the flippable column can be flipped or returned back to the display position.

In one aspect, the merchandising system comprises multiple flippable columns.

In one aspect, the merchandising system can have shelves that slope downwardly from the back of the shelves towards the front of the shelves, thereby providing gravity-feed items from the back area of the merchandising system towards the front of the merchandising system.

In one aspect, an apparatus can comprise a shelf, the shelf comprising side rails and a bottom, the shelf configured support a single row of items between the side rails; and an item stop located at the front of the shelf, wherein the item stop flexes outwardly when an item is removed from the front of the shelf, and flexes back to its original position after said removal.

Further objects, features and advantages of the present invention will become apparent from the following drawings and detailed description. The following drawings and detailed description afford a comprehensive understanding of the present invention. However, it should be understood that the described preferred embodiments are illustrative only, since various modifications within the spirit and scope of the invention may become apparent to those of ordinary skill in the art who have benefited from this disclosure.

BRIEF DESCRIPTION OF THE DRAWINGS

Non-limiting embodiments will now be described with reference to the accompanying drawings.

FIGS. 4A through 4E further illustrate various aspects of the invention.

FIGS. 30A-30E illustrate another embodiment of a front item stop.

FIGS. 32A-32E illustrate another embodiment of a front item stop.

FIGS. 33A-33E illustrate another embodiment of a front item stop.

FIGS. 34A-34D illustrate another embodiment of a front item stop.

DETAILED DESCRIPTION OF EMBODIMENTS OF THE INVENTION

Figure 1:
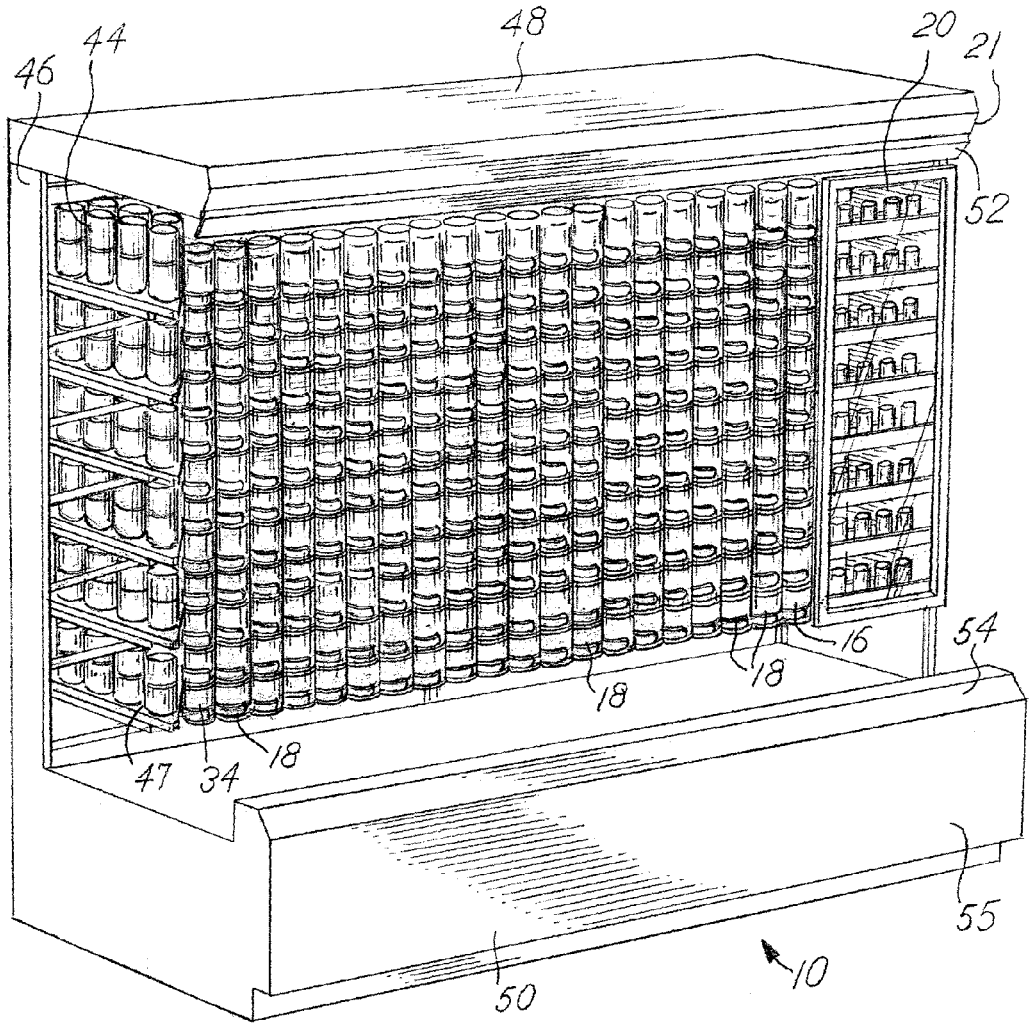
FIG. 1 is a front left perspective view of an embodiment of a merchandising system of the present invention.
Figure 6:
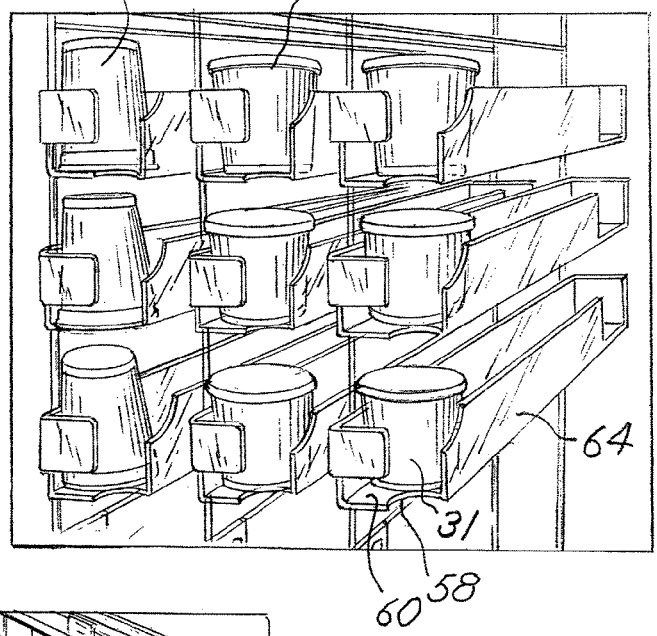
FIGS. 6-28 illustrate various aspects of the invention.
Figure 8:
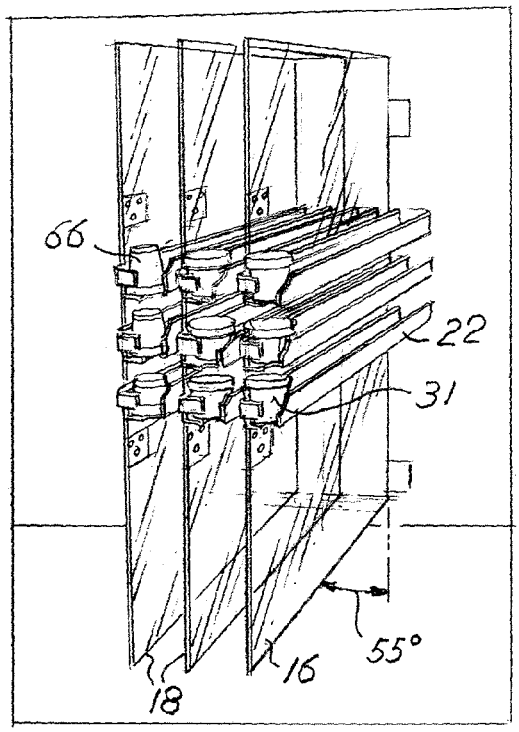

As shown in FIGS. 1-4, a one embodiment a merchandising system 10 comprises a front 12, a back wall 14, a lead flippable column 16, and flippable columns 18. Lead flippable column 16 is between a swing door 20 and the first flippable column 18 that is adjacent to lead flippable column 16. Lead flippable column 16 and flippable columns 18 can comprise rows or shelves 22 that extend from front 12 to back wall 14. FIG. 1 shows the merchandising system 10 wherein each flippable column 16 and 18 is in a display position. See also FIGS. 6 and 8. When lead flippable column 16 is in its display position and swing door 20 is closed, a person positioned in front of lead column 16 can view products displayed in the front of each row 22 of column 16 and access such products, but cannot readily view or access the length of rows 22 of lead flippable column 16. Similarly, when lead flippable column 16 is in its display position, a person positioned in front of a flippable column 18 can view products displayed in the front of each row 22 of that column 18 and access such products, but cannot readily view or access the length of rows 22 of that flippable column 18.

Figure 3:
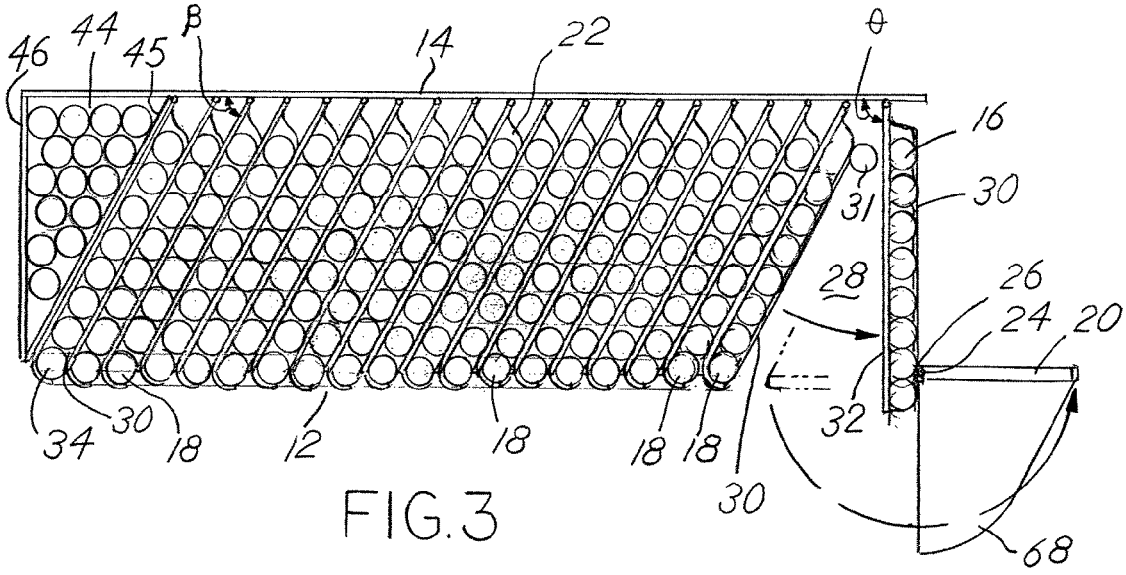
FIG. 3 is a top view of the embodiment shown in FIG. 1.
Figure 4A:
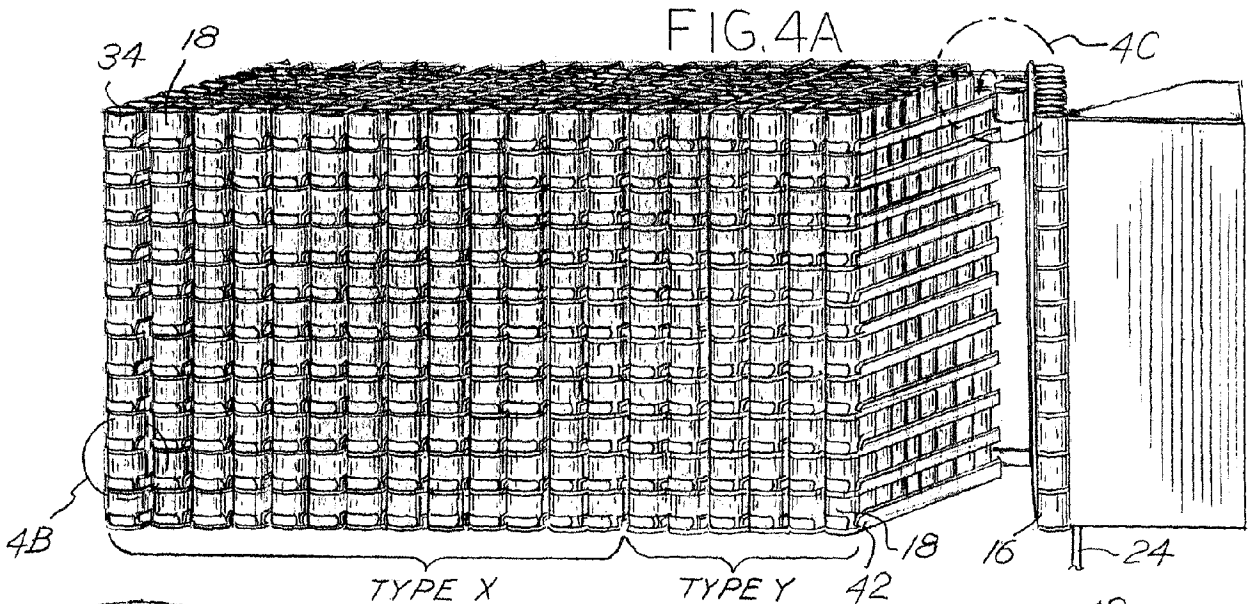
FIG. 4A is a front right perspective view of the embodiment shown in FIG. 1.
Figure 4C:
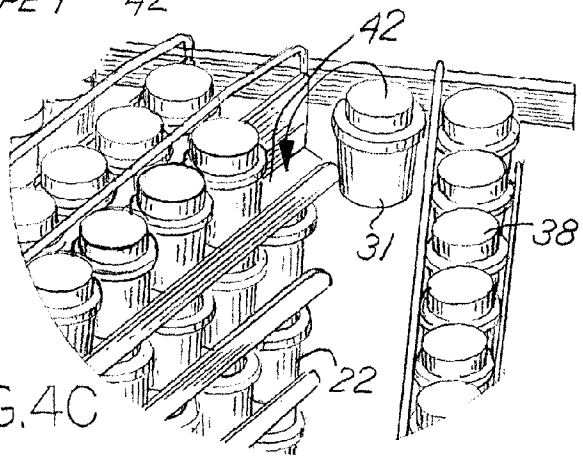
FIG. 4C is an enlarged view of the area shown in 4C of FIG. 4A.
Figure 4B:
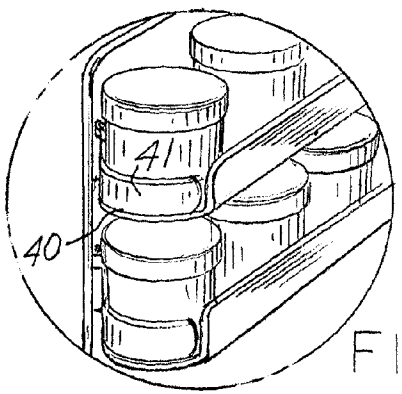
FIG. 4B an enlarged view of the area shown in 4B of FIG. 4A.
Figure 4D:
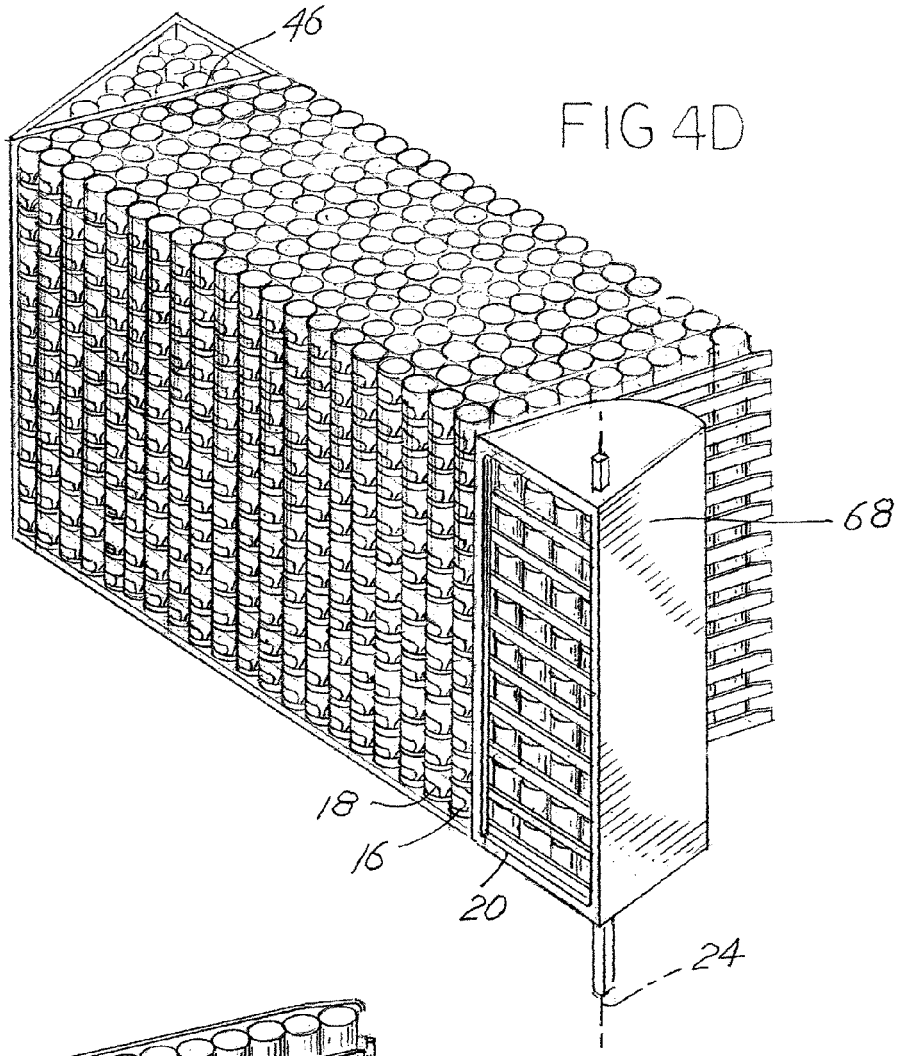
FIG. 4D is an isometric view further showing the embodiment shown in FIG. 4A with door 20 in the closed position.
Figure 4E:
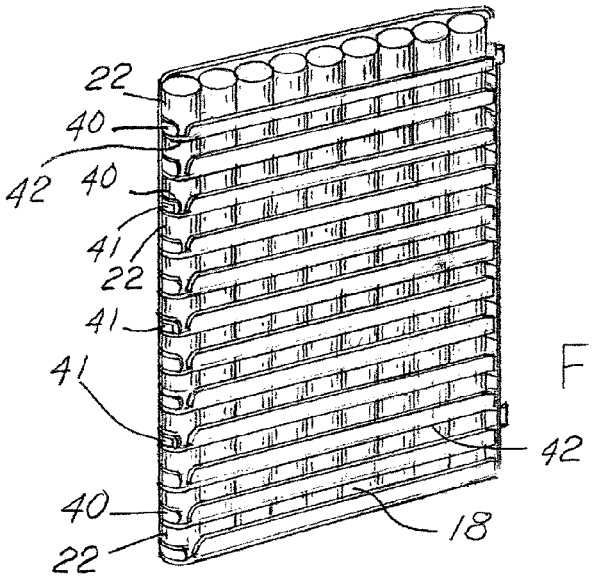
FIG. 4E is a view of one column shown in FIG. 4A.
Figure 9:
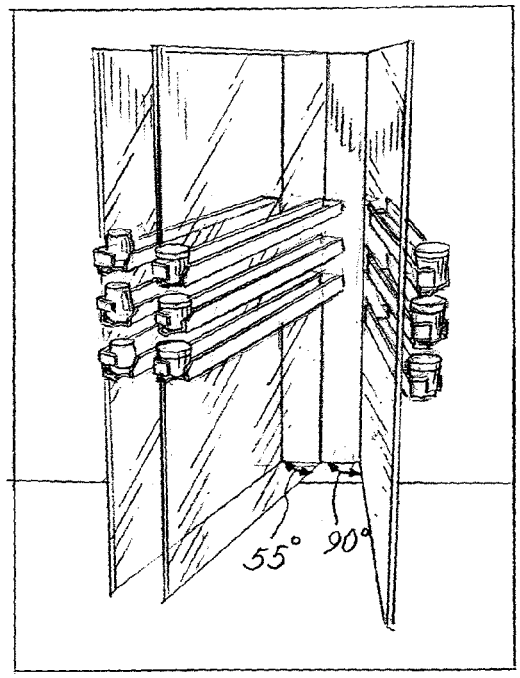

As shown in FIG. 3, flippable columns 18 are each at an angle β with respect to back wall 14. In one embodiment, each flippable column 18 and back wall 14 can form an angle β of less than 90 degrees. In one embodiment, each flippable column 18 and back wall 14 can form an angle β in the range of 50 to 60 degrees. In one embodiment, each flippable column 18 and back wall 14 can form an angle β of about 55 degrees. See also FIGS. 8-9.

Lead flippable column 16 can have the same angle β with respect to back wall 14 as do flippable columns 18 as described above. As shown in FIG. 3, lead flippable column 16 has been flipped so that the angle formed between lead flippable column 16 and back wall 14 has increased from angle β to angle θ. In one embodiment, angle θ formed by flippable column 16 and back wall 14 is in the range of 85 to 90 degrees. In one embodiment, angle θ formed by flippable column 16 and back wall 14 is about 90 degrees. As shown in FIG. 3, swing door 20 has been swung about axis 24 so that stop 26 acts as a stop for lead flippable column 16 when it is flipped to form angle θ with back wall 14.

Figure 7:
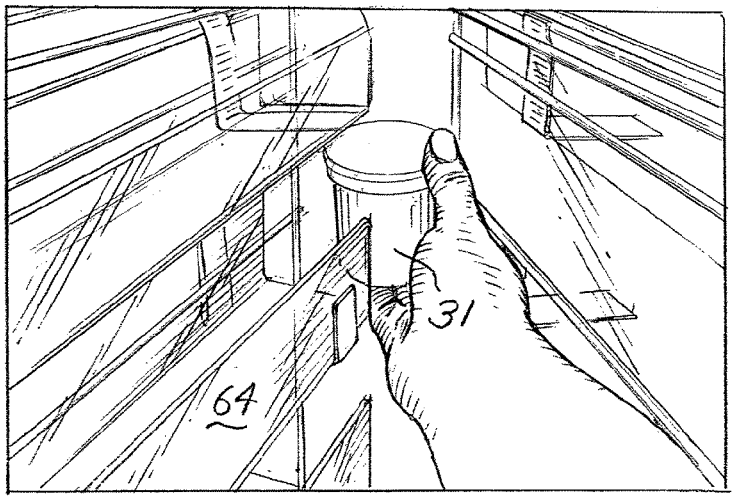
Figure 22:
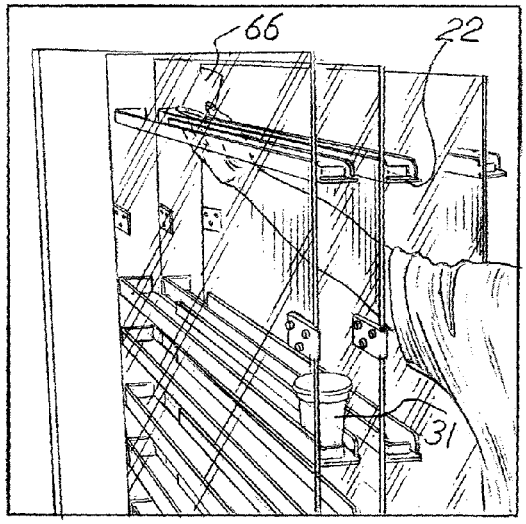

As shown in FIG. 3, when swing door 20 is swung about axis 24 from a closed position to an open position, space 28 becomes accessible to a person positioned in front of where swing door 20 was in the closed position. That person, who can be a stock person or stocker, would then have access to a first side 30 of lead flippable column 16. With such access, the person could view each row 22 along first side 30 of lead flippable column 16 from the front of the row to back wall 14. With such access, a stock person can take inventory of items on each row of lead flippable column 16, take an item(s) off of each row of lead flippable column 16, and/or add an item(s) to each row of lead flippable column 16. See also FIGS. 7, 9 and 22. With such access, a person can add items having a later expiration date behind items having an earlier expiration date for each row 22 of lead flippable column 16. Swing door 20 can have a lock (not shown) so that only authorized individuals can unlock the lock and swing open swing door 20 to access space 28.

As shown in FIG. 3, when space 28 is made accessible to a person positioned in front of space 28, lead flippable column 16 can be moved from angle β to angle θ. When lead flippable column 16 is moved from angle β to angle θ, then a person positioned in front of space 28 can access each row 22 along second side 32 of lead flippable column 16 from the front of the row to back wall 14. With such access, a stock person can take inventory of items on each row of lead flippable column 16, take an item(s) off of each row of lead flippable column 16, and/or add an item(s) to each row of lead flippable column 16. With such access, a person can add items having a later expiration date behind items having an earlier expiration date for each row 22 of lead flippable column 16. Column 16 can have any suitable structure, including but not limited to a wire grid, which permits access to items along each row 22 from either first side 30 or second side 32, or both sides 30 and 32.

When lead flippable column 16 is moved from angle β to angle θ, then a person positioned in front of space 28 can view each row 22 along first side 30 of the flippable column 18 that is immediately adjacent to lead flippable column 16, from the front of the row to back wall 14. With such access, a stock person can take inventory of items on each row of the flippable column 18 that is immediately adjacent to lead flippable column 16, take an item(s), such as item 31 off of each row of that flippable column 18, and/or add an item(s), such as item 31, to each row of that flippable column 18. With such access, a person can add items having a later expiration date behind items having an earlier expiration date for each row 22 of that flippable column 18.

The process of flipping consecutive flippable columns 18 can be repeated as desired in order to obtain access to side of each flippable column 18. Column 34, which is the furthest column from lead flippable column 16, may be flippable or non-flippable. There is no need for column 34 to be flippable because first side 30 of column 34 becomes accessible when flippable column 18 immediately adjacent to column 34 is flipped from angle β to angle θ.

The process of flipping the lead flippable column 16 and consecutive flippable columns can be performed by flipping the columns one at a time, in pairs, or groups of 3 or more columns at a time. Flipping columns in pairs is the most efficient way of accessing a second side 32 of a flippable column 18 and accessing at the same time the first side 30 of the next adjacent flippable column 18, in seriatim. First side 30 and second side 32 of flippable column 18 can be just like first side 30 and 32 of column 16, i.e., each side opposite the other. Flippable column(s) 18 can have any suitable structure, including but not limited to a wire grid, which permits access to items along each row 22 from either first side 30 or second side 32, or both sides 30 and 32.

Figure 23:
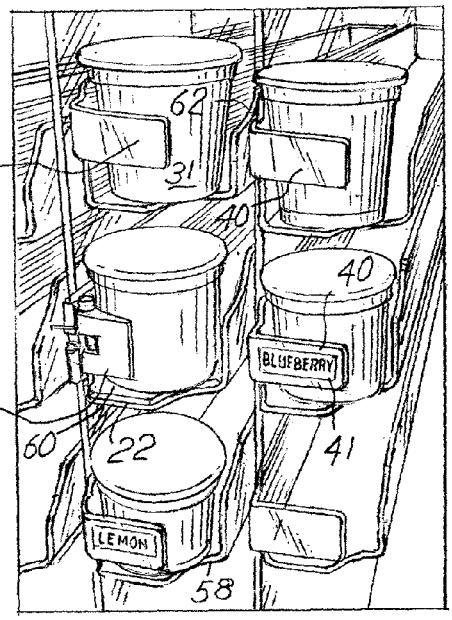
Figure 24:
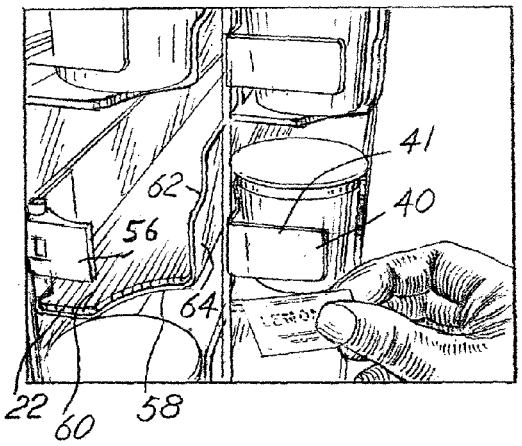
Figure 25:
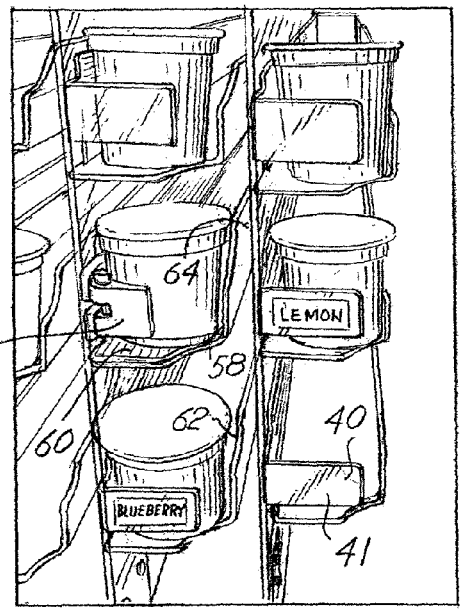

As shown in FIG. 4, various shapes and sizes of products or items, including but not limited to Type X items, Type Y items, and/or items 31 and 38, and/or item 66 (depicted in FIG. 5), can be displayed by merchandising system 10. See also FIGS. 16-19. At the front of each row can be a front item stop 40. Front item stop 40 can be transparent or non-transparent, and can be made of any suitable material. Front item stop 40 can be flexible so that it flexes outwardly during removal of an item from the front of row 22, and, after said item removal, then flexes back to its original position to act as a stop for the next item in the row. Information selected from the group consisting of price, unit amount, price per weight, and SKU, and any combination thereof can be placed on front 41 of front item stop 40. See also FIGS. 23-25.

Each row or tray 22 can have a slide tray 42 devoted to a particular product, brand of product and/or flavor for easy swapping of rows. The trays can be made of any suitable material, including but not limited to wire, metal brackets, and/or plastic, including injection molded plastic. The rows or trays can be universal to support various products of different shapes and sizes.

Figure 20:
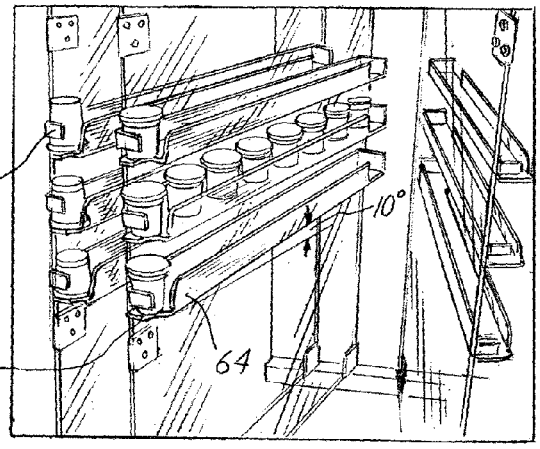

Rows 22 and columns 16, 18 and 34 can be made of any suitable material, including but not limited to wire, metal brackets, and/or plastic, including injection molded plastic. See also FIGS. 26-28. Rows 22 can slope downwardly from back to front so that product or items in each row are gravity-fed towards the front of each row. The downward slope of rows 22 can be any suitable angle, including but not limited to around 10 degrees downward from horizontal. See e.g., FIG. 20.

A pricing display panel for items in each row can be placed on the front of the bottom portion of each row or placed on the front of the bottom portion or every other row, etc. as may be desired.

FIG. 4 illustrates how a single item 31 can be placed at the back of a row 22 of a flippable column 18.

Figure 2:
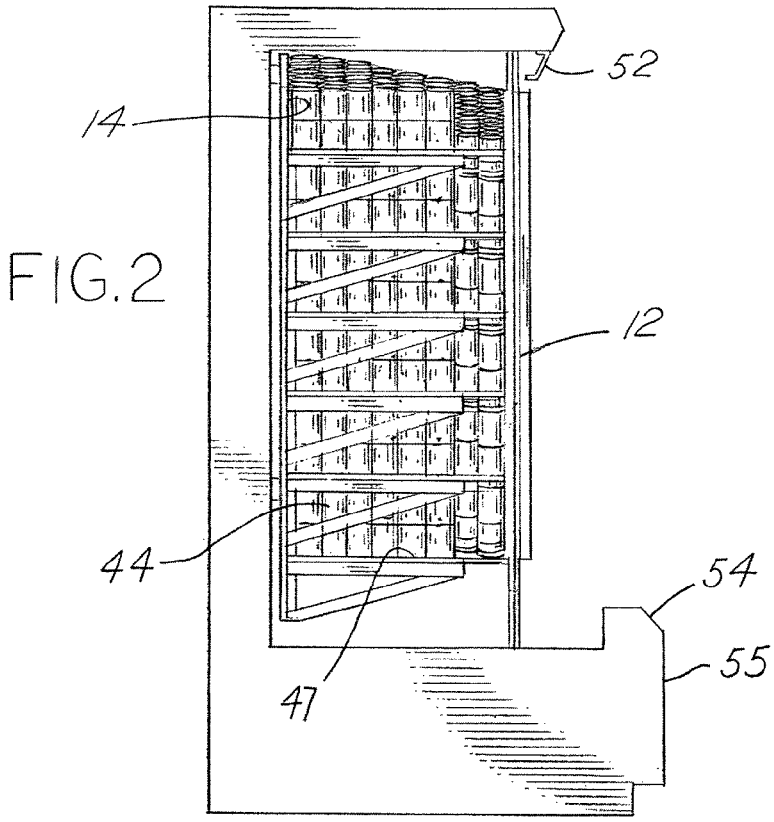
FIG. 2 is a side view of the embodiment shown in FIG. 1.

In one embodiment, merchandising system 10 can have a storage area for items separate from columns 16, 18, and 34. As shown in FIGS. 1-3, storage area 44 is located at end 46 of merchandising system 10. End 46 is opposite end 21 of merchandising system 10. Storage area 44 can have a wall 45 that acts as a stop for column 34. Storage area 44 can be used for additional display and/or storage of items. Storage area 44 can have multiple shelves 47.

Merchandising system 10 can comprise a top 48, and a bottom portion 50. Top 48 can have an extra branding and sellable advertising panel 52. Bottom portion 50 can have an extra branding and sellable advertising panels 54 and 55.

Figure 5:
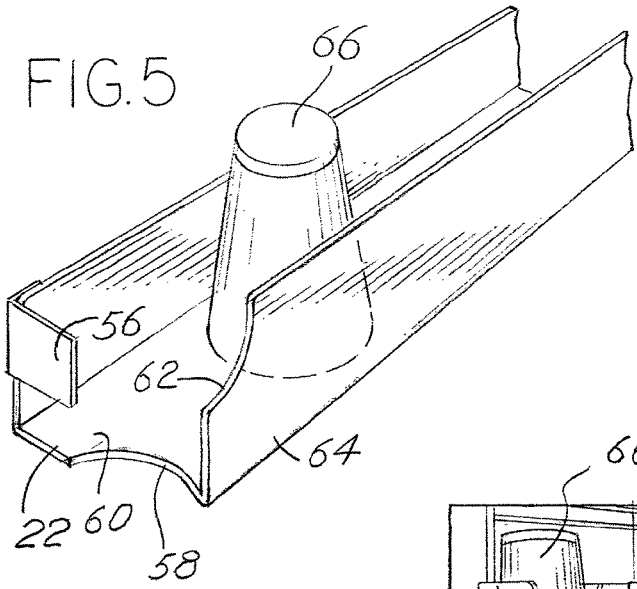
FIG. 5 is a front right perspective view illustrating aspects of a front stop, a cut away on the front of a shelf, and a cut away on the side wall.
Figure 10:
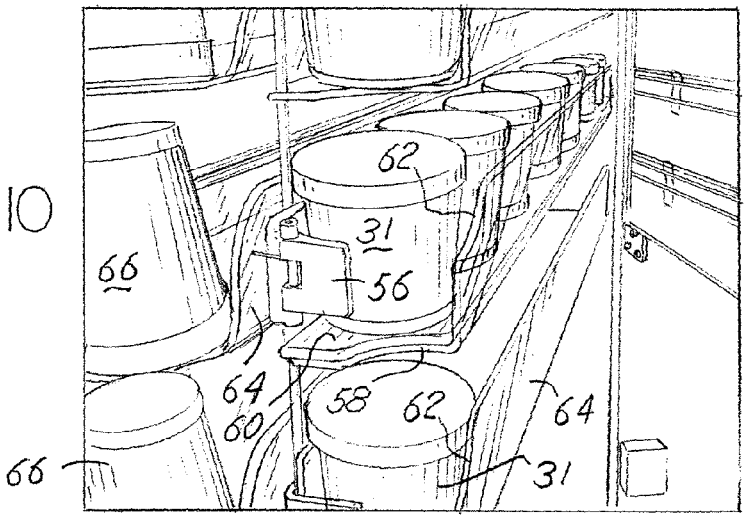
Figure 11:
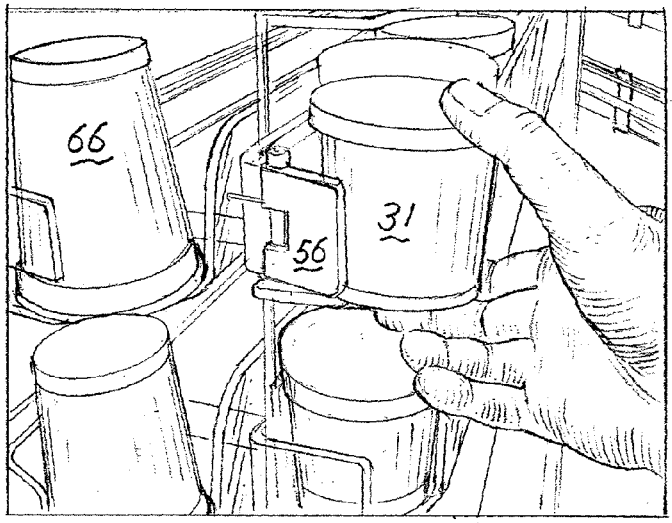
Figure 12:
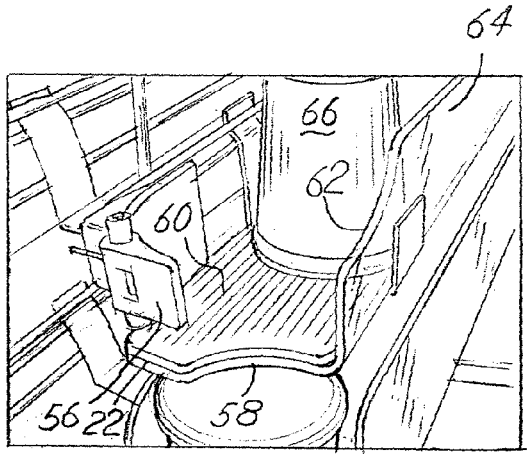

FIG. 5 is a front right perspective view illustrating aspects of a front item stop, a cut away on the front of a shelf, and a cut away on the side wall. As shown in FIG. 5, front item stop 56 of each row 22 can be reduced in size from front item stop 40 shown in FIG. 4 to expose more labeling of products, and to permit easier removal of item(s), including but not limited to items 66, 31 and/or 38, from the row. Front item stop 56 can be flexible so that it flexes outwardly during removal of an item from the front of row 22, and, after said item removal, then flexes back to its original position to act as a stop for the next item in the row. A cut away portion 58 in floor 60 of row 22 can permit easier removal of items from the front of the row. A cut away portion 62 in the front of side wall 64 of row 22 can permit easier removal of items from the front of the row. See also FIGS. 10-12.

Figure 13:
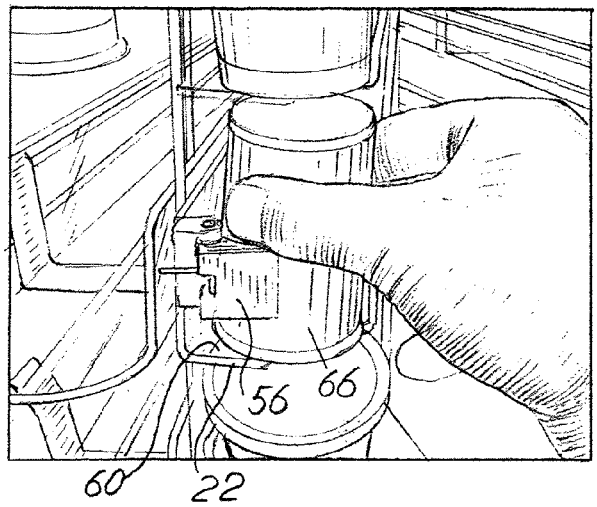
Figure 14:
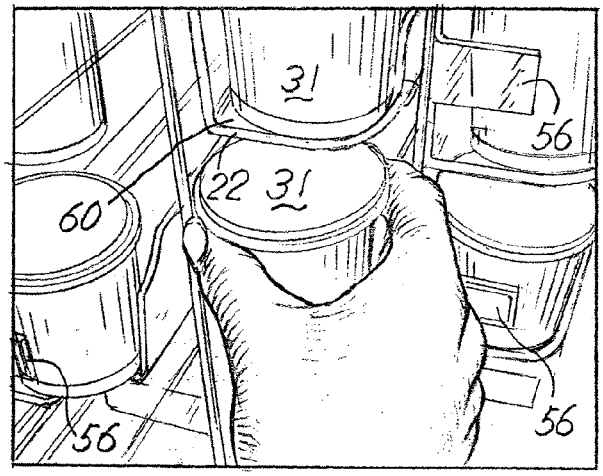
Figure 15:
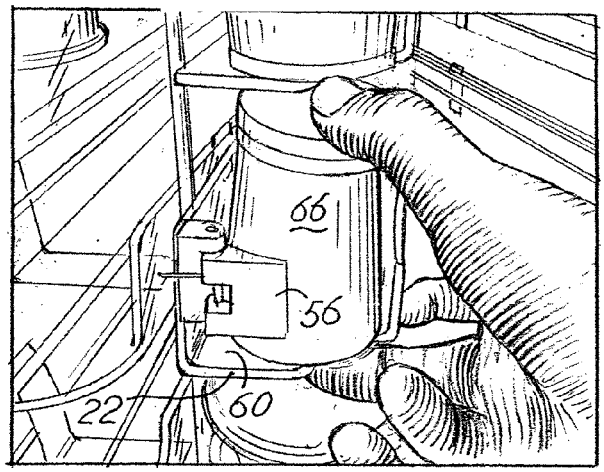
Figure 16:
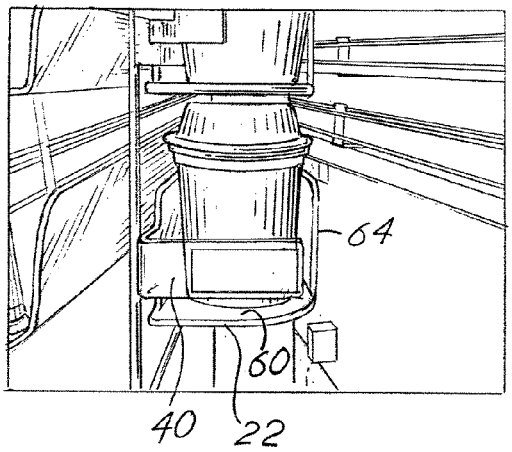
Figure 17:
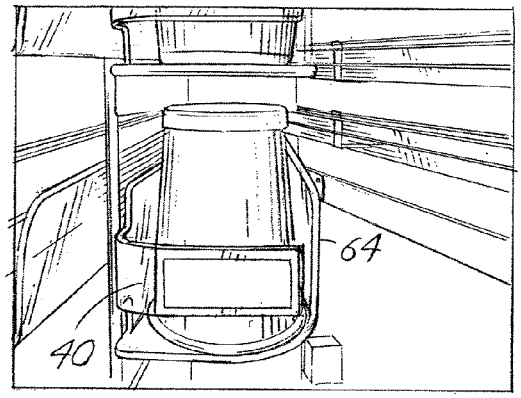
Figure 18:
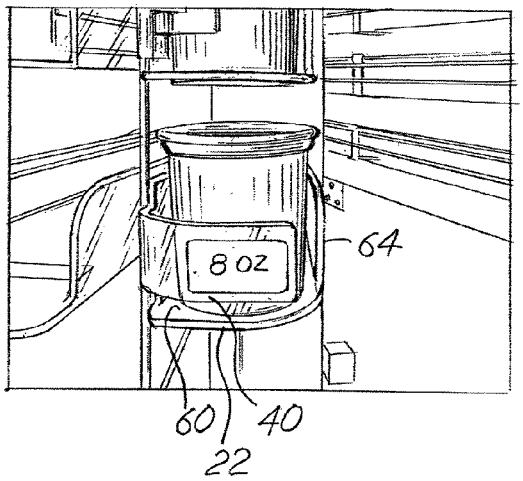
Figure 19:
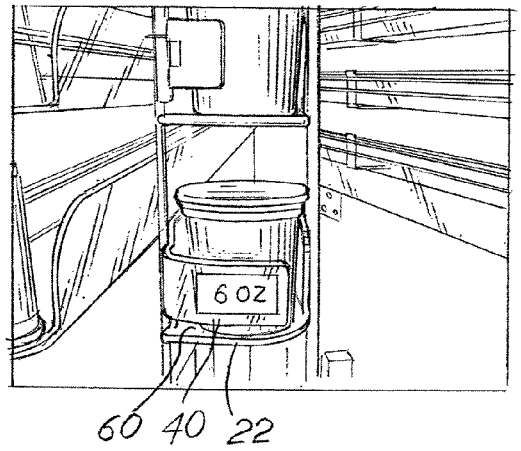
Figure 21:
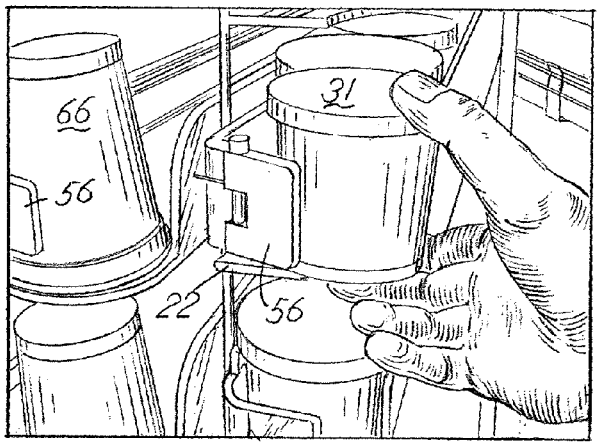

An item can be removed from a row by grasping the item at its side wall, at the item's top, at the item's bottom, or combination thereof. See e.g., FIGS. 13-15. An item can be placed on a row 22 from the front by inserting an item behind item stop 56 (see FIG. 21) and/or loading from the rear (see FIG. 22).

Rows or shelves 22 can be designed to support any size items, including but not limited to six (6) ounce items, eight (8) once items, and items packaged in containers having vertical side walls and tapered side walls, etc.

Storage area 68 located at end 21 of merchandising system 10 can be used for put backs of items taken from rows 22, and/or additional display and/or storage of items.

Merchandising system 10 can provide for display of various shaped and sized items. Rows and columns of system 10 can be universal to support various shaped and sized items.

The rows of system can be any suitable length or depth, including but not limited to about twenty-four (24) inches.

When merchandising system 10 is used to display yogurt products in a retail store, the highest facing yogurt can be about seventy-two (72) inches from the ground. The yogurt section can be about eight (8) feet long, and have about nineteen (19) to twenty (20) columns or doors in the section. Each column can have about eleven (11) rows or shelves. Each row or shelf can support eight (8) to ten (10) yogurt items, depending on the size of the yogurt packages or containers.

Merchandising system 10 can include a refrigeration unit (not shown), and transparent refrigerator swing doors (not shown) in front of columns 16, 18, and 34.

Figure 26:
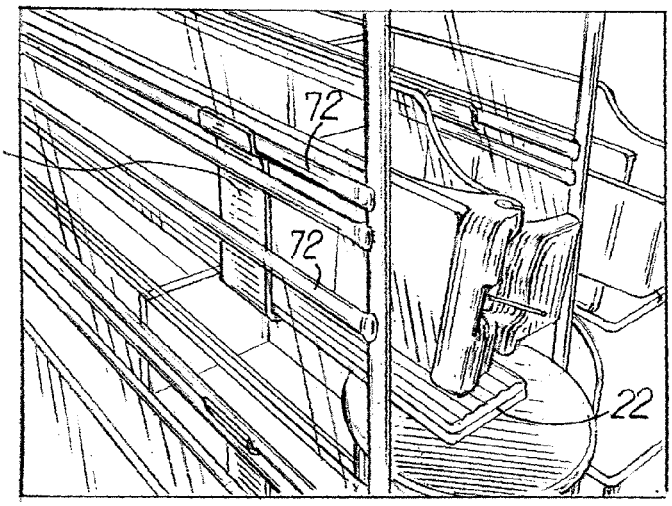
Figure 27:
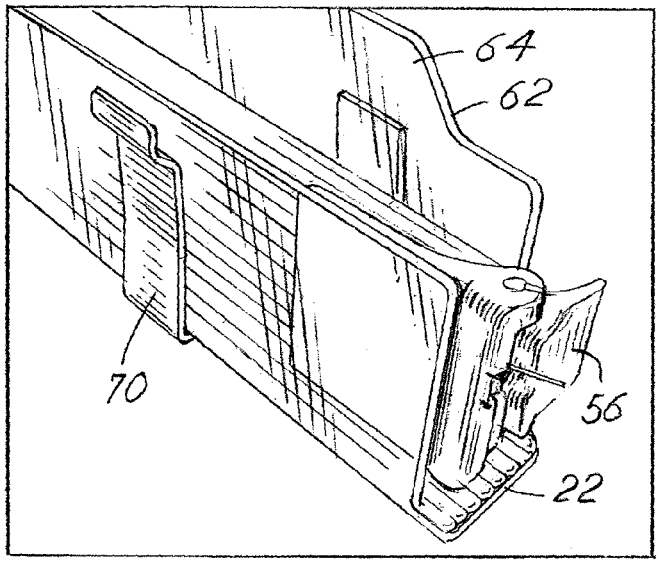
Figure 28:
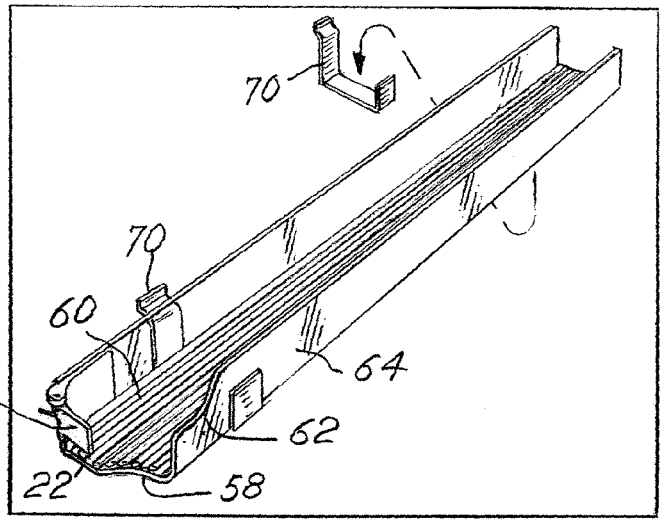
Figure 29A:
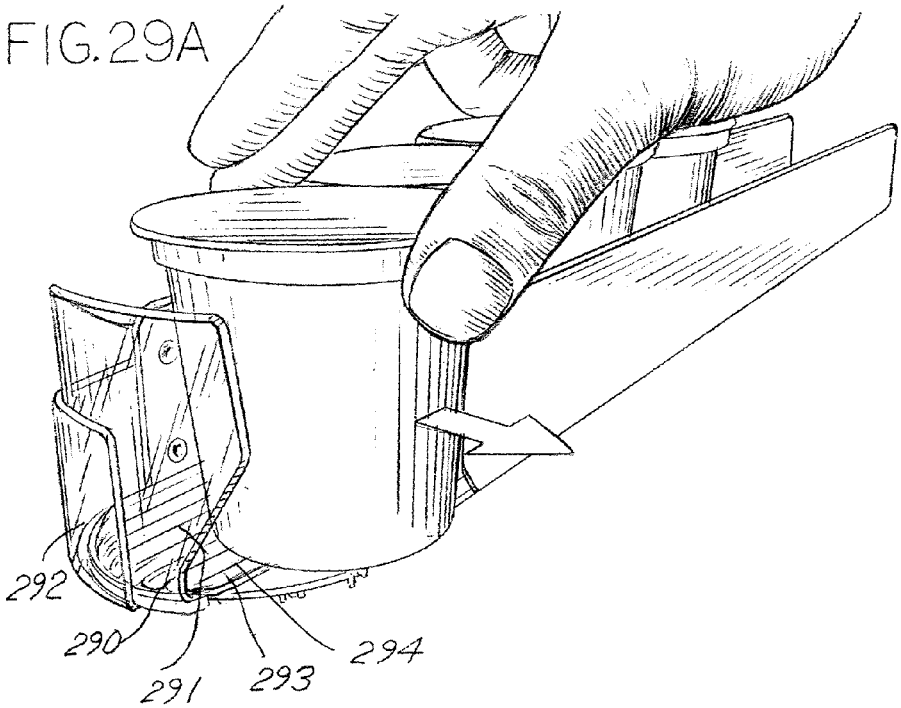
FIGS. 29A-29D illustrate an embodiment of front item stop.
Figure 29B:
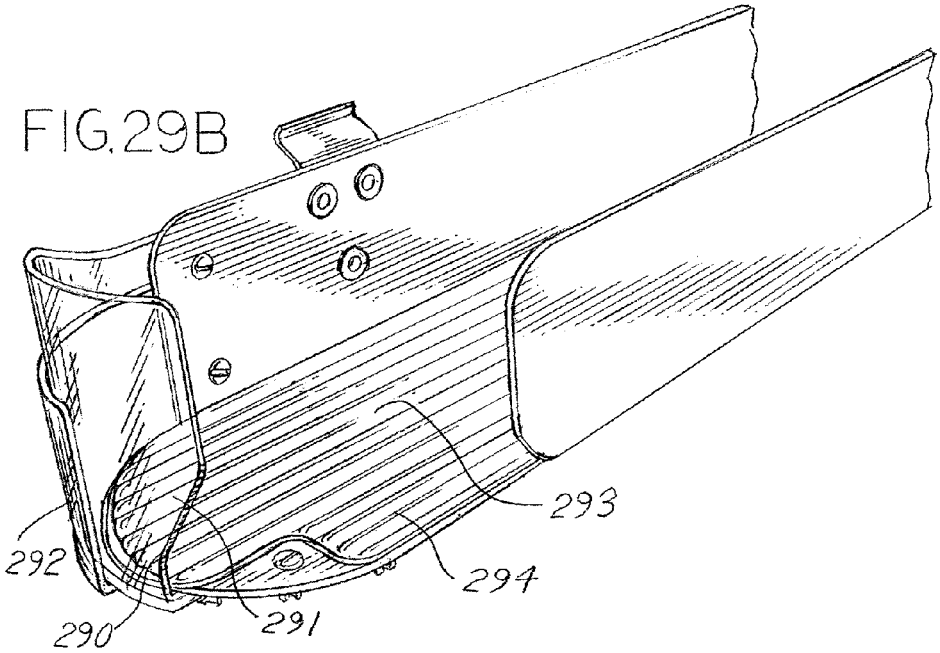
Figure 29C:
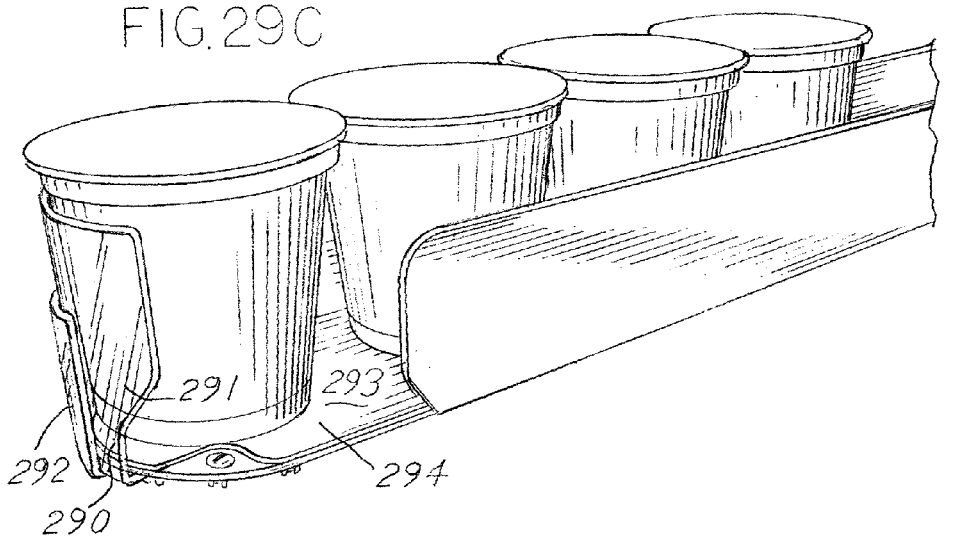
Figure 29D:
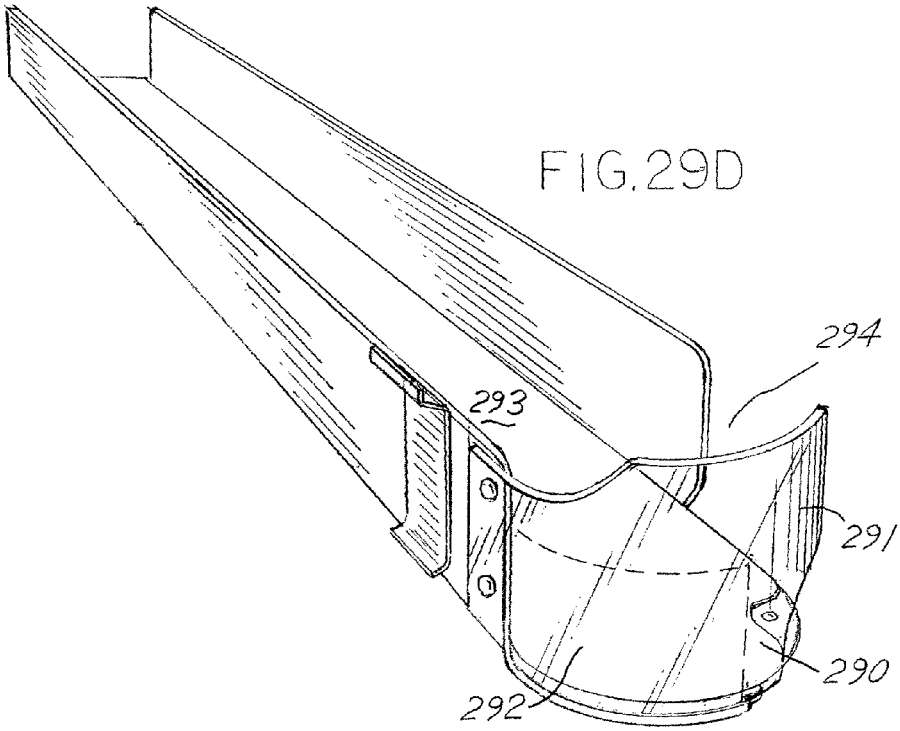

FIGS. 6-28 illustrate various aspects of the invention. FIGS. 26-28 show brackets 70 for hanging shelves or trays 22 within merchandising system 10. FIG. 26 shows bracket 70 held by rods 72.

FIGS. 29A-29D illustrate an embodiment of front item stop 290. Front item stop 290 comprises a front face 291, which may or may not be transparent. In the embodiment shown in FIGS. 29A-29D, front face 291 is transparent. Front face 291 can have a designated portion 292. A label (not shown) comprising information selected from the group consisting of price, unit amount, price per weight, and SKU, and any combination thereof that corresponds to the items placed on or to be placed on row or shelf 293 can be placed on designated portion 292. Such label can be removed from designated portion 292 and/or covered over with another label at later time if desired. Items can be removed from row 293 via opening 294. Front item stop 290 can be flexible so that it flexes outwardly during removal of an item from the front of row 293, and, after said item removal, then flexes back to its original position to act as a stop for the next item in the row. Row or shelf 293 can comprise side rails and a bottom (shown in the figures but not numbered), and can be configured support a single row of items between the side rails.

Figure 30C:
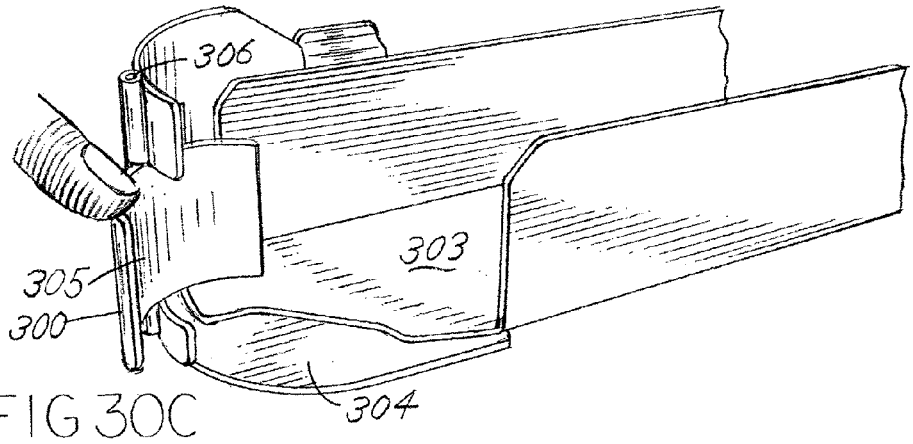
Figure 30D:
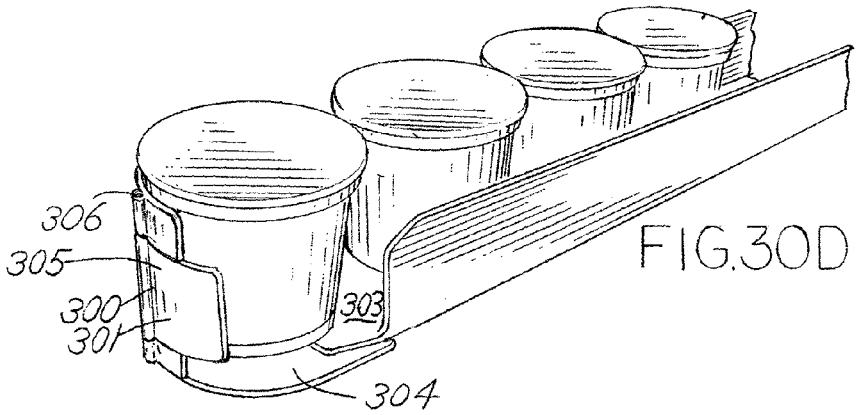
Figure 30E:
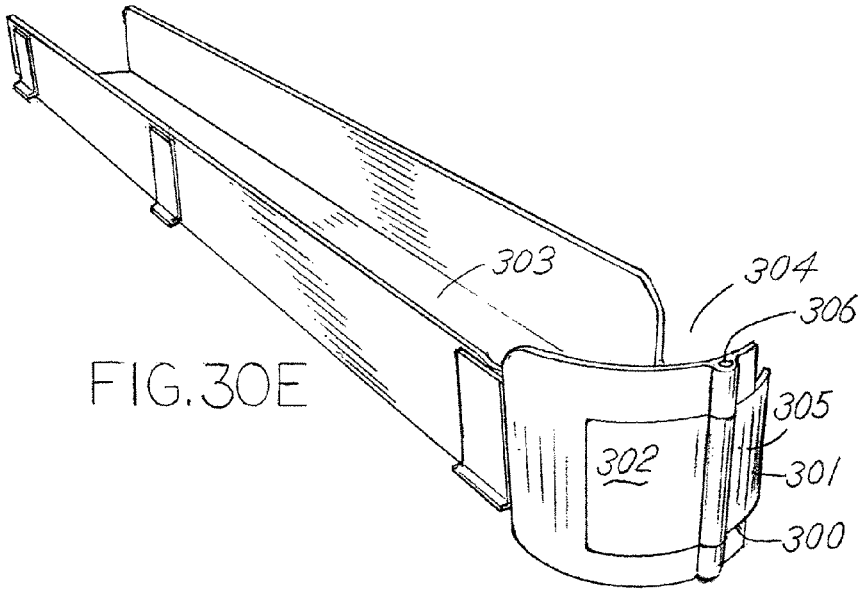
Figure 31A:
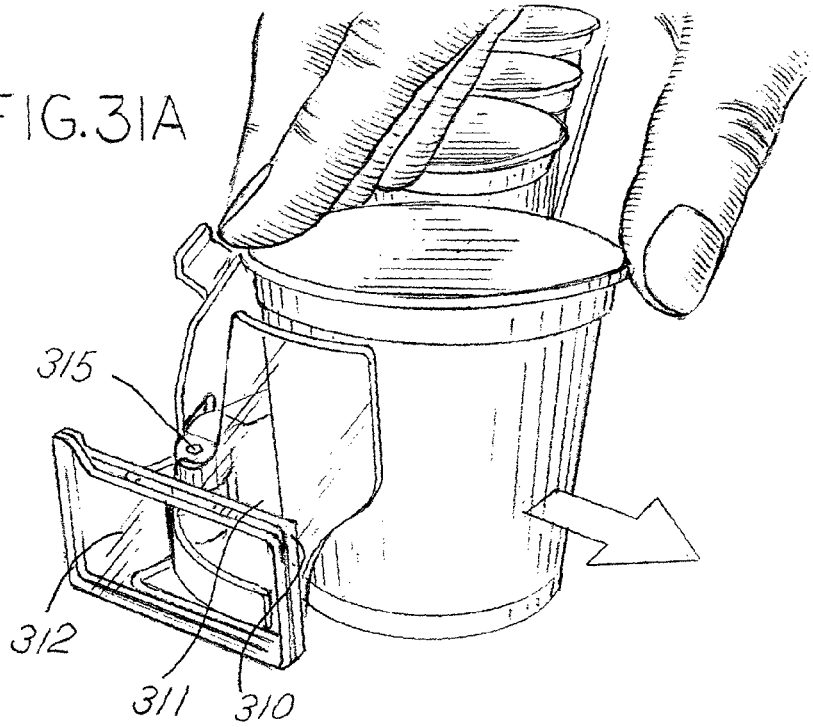
FIGS. 31A-31E illustrate another embodiment of a front item stop.
Figure 31B:
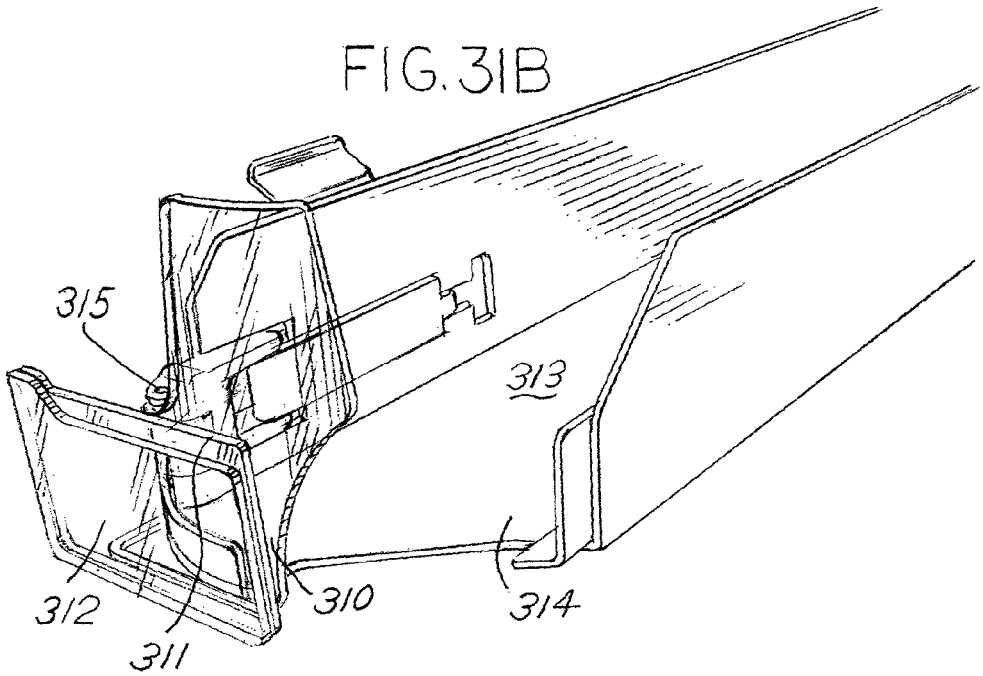
Figure 31C:
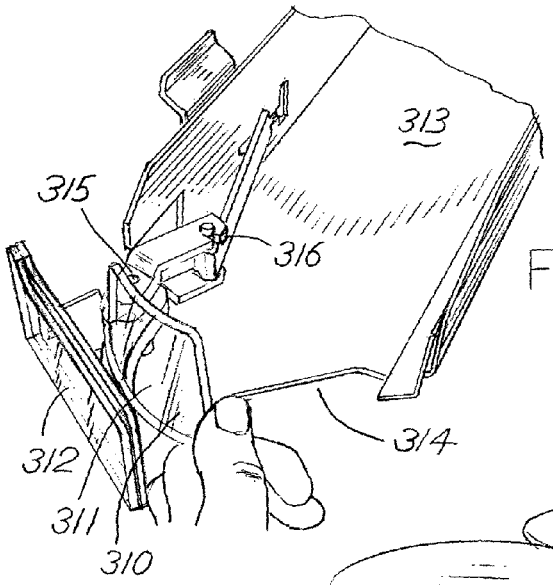
Figure 31D:
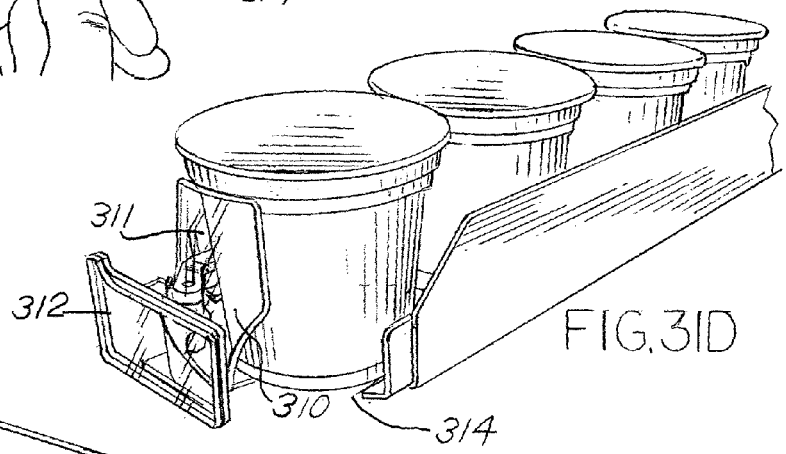
Figure 31E:
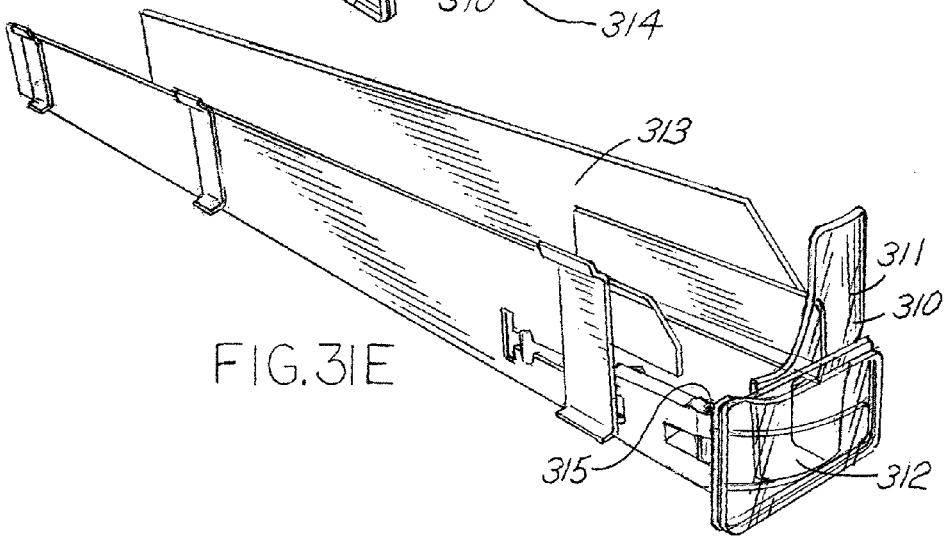
Figure 32A:
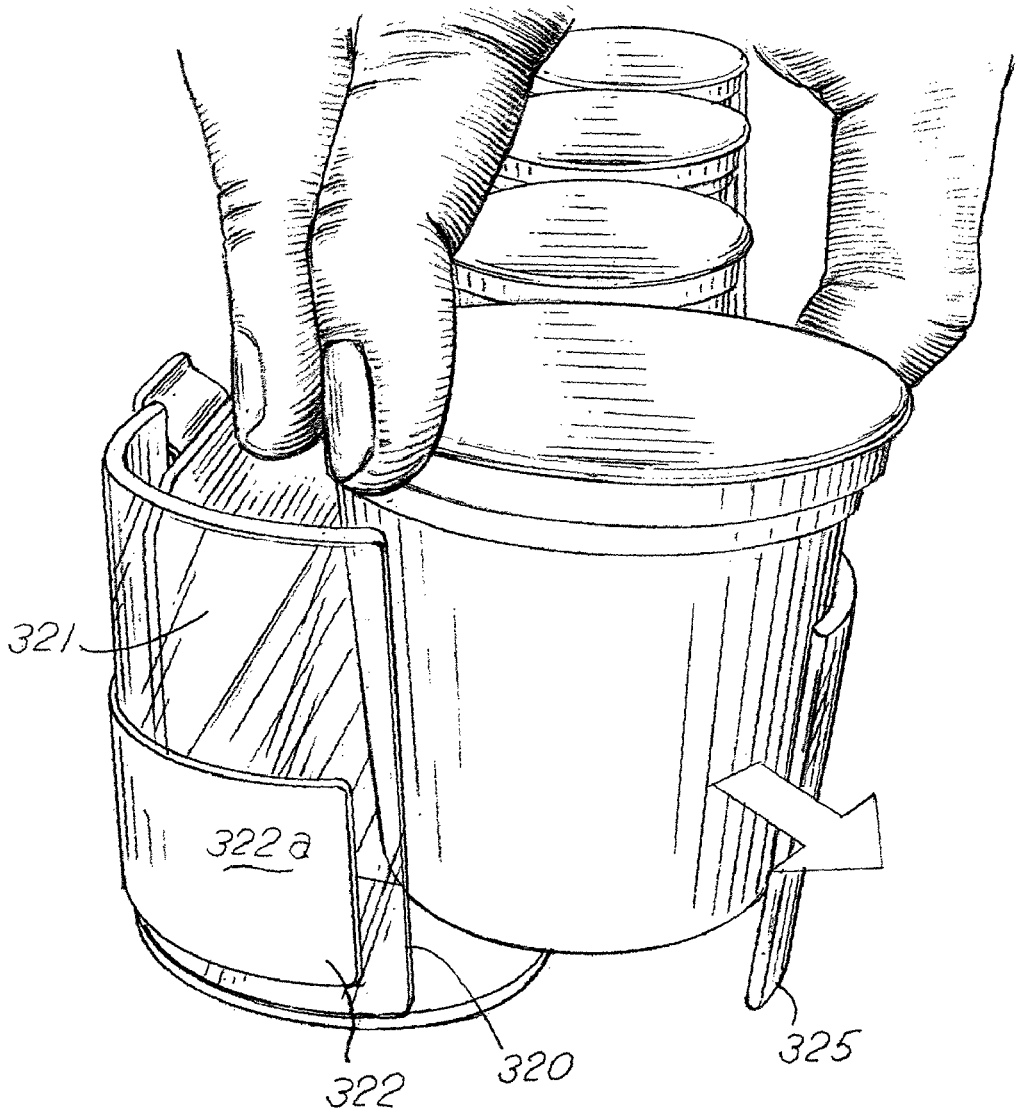
Figure 32B:
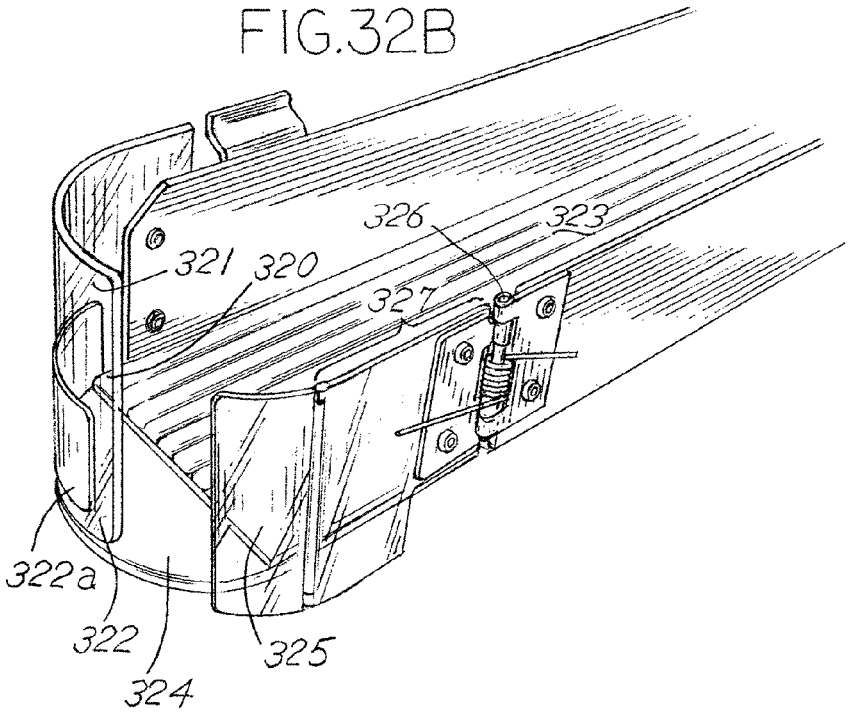
Figure 32C:
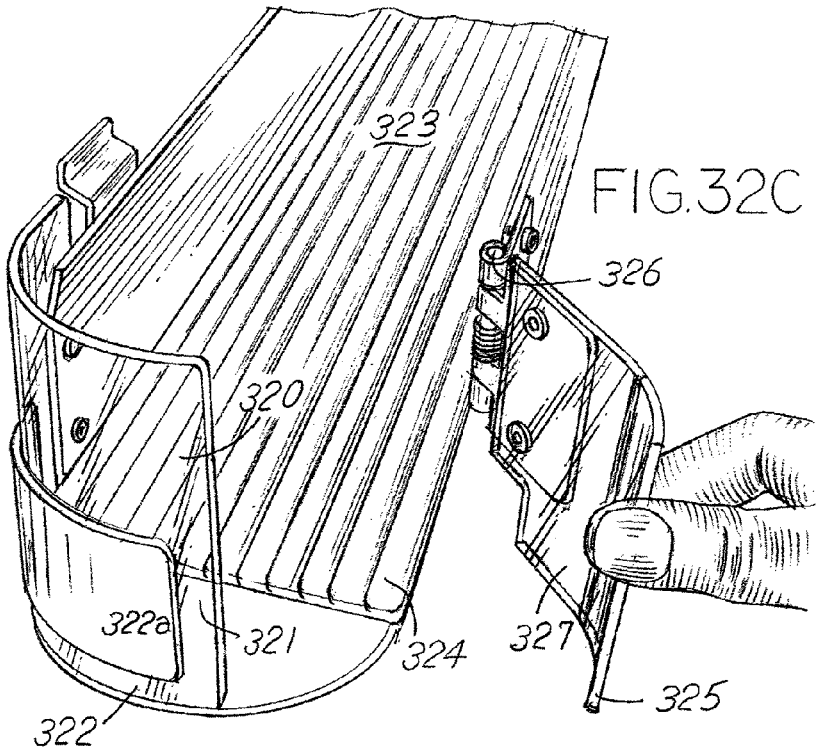
Figure 33D:
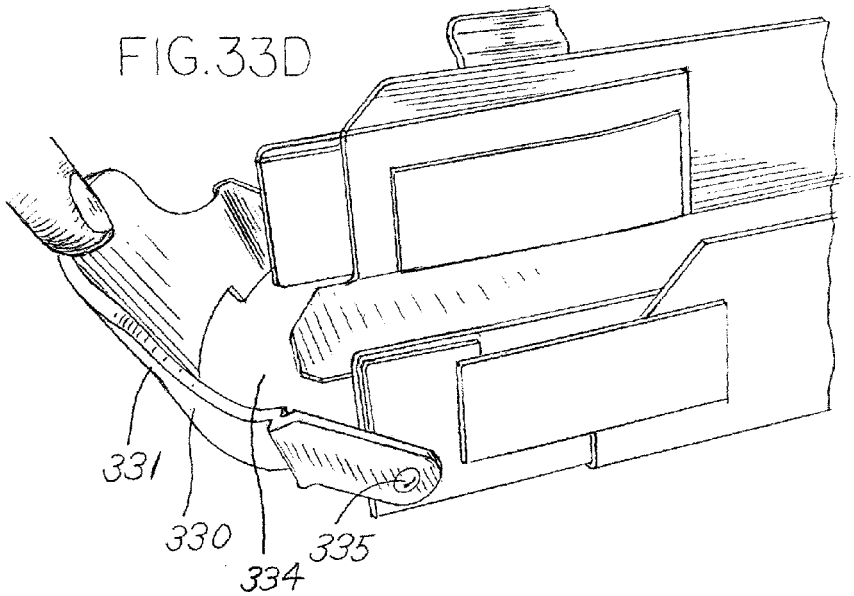
Figure 33E:
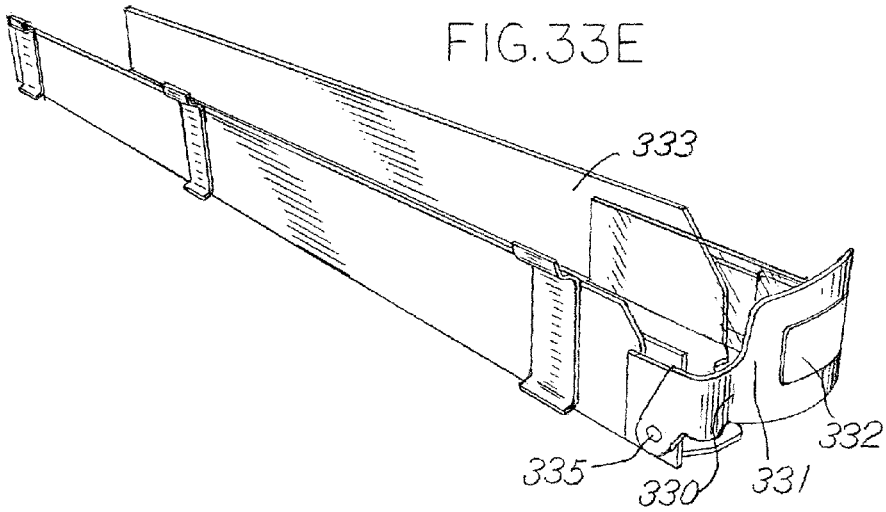

FIGS. 30A-30E illustrate another embodiment of a front item stop. Front item stop 300 comprises a front face 301, which may or may not be transparent. In the embodiment shown in FIGS. 30A-30E, front face 301 is not transparent. Front face 301 can have a designated portion 302 as shown in FIG. 30E. A label (not shown) comprising information selected from the group consisting of price, unit amount, price per weight, and SKU, and any combination thereof that corresponds to the items placed on or to be placed on row or shelf 303 can be placed on designated portion 302. Such label can be removed from designated portion 302 and/or covered over with another label at later time if desired. Items can be removed from row 303 via opening 304. Curved portion 305 can flex or pivot outwardly from hinge 306 during removal of an item from the front of row 303, and, after said item removal, then flexes or pivots back to its original position to act as a stop for the next item in the row. Row or shelf 303 can comprise side rails and a bottom (shown in the figures but not numbered), and can be configured support a single row of items between the side rails.

FIGS. 31A-31E illustrate another embodiment of a front item stop. Front item stop 310 comprises a front face 311, which may or may not be transparent. Front face 311 can have a designated portion 312. A label (not shown) comprising information selected from the group consisting of price, unit amount, price per weight, and SKU, and any combination thereof that corresponds to the items placed on or to be placed on row or shelf 313 can be placed on designated portion 312. Such label can be removed from designated portion 312 and/or covered over with another label at later time if desired. Items can be removed from row 313 via opening 314. Front face 311 can flex or pivot outwardly from hinge 315 during removal of an item from the front of row 313, and, after said item removal, then flexes or pivots back to its original position to act as a stop for the next item in the row. As front face 311 flexes or pivots outwardly, second item stop 316 pivots inwardly to act as a stop for the item immediately behind the item being removed. As front face 311 flexes or pivots back to its original position after removal of an item, second item stop 316 pivots back to its original position to allow the next item in row 313 to advance past the second item stop 316, and be stopped by front face 311. Row or shelf 313 can comprise side rails and a bottom (shown in the figures but not numbered), and can be configured support a single row of items between the side rails.

FIGS. 32A-32E illustrate another embodiment of a front item stop. Front item stop 320 comprises a front face 321, which may or may not be transparent. In the embodiment shown in FIGS. 32A-32E, front face 321 is transparent. Front face 321 can have a designated portion 322. A label 322*a* comprising information (not shown) selected from the group consisting of price, unit amount, price per weight, and SKU, and any combination thereof that corresponds to the items placed on or to be placed on row or shelf 323 can be placed on designated portion 322. Such label 322*a* can be removed from designated portion 322 and/or covered over with another label at later time if desired. Items can be removed from row 323 via opening 324. Curved portion 325 can flex or pivot outwardly via hinge 326 during removal of an item from the front of row 323, and, after said item removal, then flexes or pivots back to its original position to act as a stop for the next item in the row. Curved portion 325 can be attached to a connecting portion 327, which in turn is directly attached to hinge 326. Row or shelf 323 can comprise side rails and a bottom (shown in the figures but not numbered), and can be configured support a single row of items between the side rails.

FIGS. 33A-33E illustrate another embodiment of a front item stop. Front item stop 330 comprises a front face 331, which may or may not be transparent. Front face 331 can have a designated portion 332. A label (not shown) comprising information selected from the group consisting of price, unit amount, price per weight, and SKU, and any combination thereof that corresponds to the items placed on or to be placed on row or shelf 333 can be placed on designated portion 332. Such label can be removed from designated portion 332 and/or covered over with another label at later time if desired. Items can be removed from row 333 via opening 334. Front face 331 can flex or pivot outwardly (in this embodiment, the outward movement is downwardly) from hinge 335 during removal of an item from the front of row 333, and, after said item removal, then flexes or pivots back to its original position to act as a stop for the next item in the row. Row or shelf 333 can comprise side rails and a bottom (shown in the figures but not numbered), and can be configured support a single row of items between the side rails.

FIGS. 34A-34D illustrate an embodiment of front item stop 340. Front item stop 340 comprises a front face 341, which may or may not be transparent. In the embodiment shown in FIGS. 34A-34D, front face 341 is not transparent. In this embodiment, front item stop 340 is basically a strap. Front item stop or strap 340 can made sufficiently sized to have designated portion (not shown) upon which a label (not shown) comprising information selected from the group consisting of price, unit amount, price per weight, and SKU, and any combination thereof can be placed and which corresponds to the items placed on or to be placed on row or shelf 343. Such label can be removed from designated portion and/or covered over with another price label and/or SKU identification label at later time if desired, or alternatively, strap 340 can be simply replaced with another strap 340 if desired. Items can be removed from row 343 by simply lifting each item as desired as shown in FIG. 34A. Front item stop or strap 340 can pivot slightly downward during removal of an item from the front of row 343, but not so much that it will not stop the next item in the row after an initial item is removed. Row or shelf 343, like other rows or shelves disclosed herein, can have a downward slope to gravity feed items from the back of each row to the front of each row. As shown in FIGS. 34A-34D, a row can have two portions 348 and 349, each of which has a different downward slope. As illustrated in FIGS. 34A-34D, front sloped portion 348 has a greater downward slope than rear sloped portion 349. Row or shelf 343 can comprise side rails and a bottom (shown in the figures but not numbered), and can be configured support a single row of items between the side rails.

The present invention has been described in detail with particular reference to certain preferred embodiments thereof, and those of skill in the art will appreciate that variations and modifications are within the spirit and scope of the present invention.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A merchandising system comprising:

a front, a back area, a swing door located at the front, the swing door moveable about an axis between a closed position and an open position; and a lead flippable column having a first side and a second side, the first and second sides of the lead flippable column parallel to each other and extending from the front to the back area, and at least one non-lead flippable column, wherein the lead flippable column is positioned between the swing door and the non-lead flippable column, the first side of the lead flippable column closer to the swing door than the second side of the lead flippable column, the second side of the lead flippable column closer to the non-lead flippable column than the first side of the lead flippable column, the flippable column and the non-lead flippable column each comprising a plurality of shelves, the shelves in the flippable column and the non-lead flippable column extending from the front to the back area, each shelf configured to support a single row of items, and wherein the first side of the lead flippable column at the back area is non-accessible from the front when the swing door is in the closed position, and is accessible from the front when the swing door is in the open position.

2. The merchandising system of claim 1, wherein the second side of the lead flippable column is at a first angle with respect to a back wall of the merchandising system, the first angle less than 90 degrees.

3. The merchandising system of claim 2, wherein the first angle is in the range of 50 to 60 degrees.

4. The merchandising system of claim 2, wherein when the swing door is in the open position, and the lead flippable column is flipped towards the swing door, the second side of the lead flippable column is at a second angle with respect to the back wall, the second angle greater than the first angle.

5. The merchandising system of claim 4, wherein the second angle is in the range of 85 to 90 degrees.

6. The merchandising system of claim 4, wherein the lead flippable column is stopped by a column stop when it is at the second angle with respect to the back wall.

7. The merchandising system of claim 4, wherein the second side of the lead flippable column becomes accessible from the front when the second side of the lead flippable column is at the second angle with respect to the back wall.

8. The merchandising system of claim 7, wherein the non-lead flippable column has a first side and a second side, the first and second sides of the non-lead flippable column parallel to each other and extending from the front to the back area, the first side of the non-lead flippable column closer to the lead flippable column than the second side of the non-lead flippable column, the first side of the non-flippable column at the back area being non-accessible from the front when the lead flippable column has not been flipped towards the swing door, the first side of the non-flippable column at the back area being accessible from the front when the lead flippable column has been flipped towards the swing door.

9. The merchandising system of claim 8, wherein the second side of the non-lead flippable column at the back area becomes accessible from the front when the lead flippable column and the non-lead flippable column have been flipped towards the swing door.

10. The merchandising system of claim 9, wherein the non-lead flippable column comprises a plurality of consecutive non-lead flippable columns, each non-lead flippable column having a first side at the back area being non-accessible from the front when the lead flippable column and any non-flippable column closer to the lead flippable column has not been flipped towards the swing door.

11. The merchandising system of claim 10, wherein each second side at the back area corresponding to a non-flippable column becomes accessible from the front when that non-lead flippable column has been flipped towards the swing door.

12. The merchandising system of claim 1, wherein at least one shelf is made from a material selected from the group consisting of wire, metal brackets, or plastic, and any combination thereof.

13. The merchandising system of claim 1, wherein each shelf slopes downwardly from the back area to the front.

14. The merchandising system of claim 1, further comprising an item stop located at the front of at least shelf.

15. The merchandising system of claim 14, further comprising item information placed on the front of the item stop, the item information selected from the group consisting of price, unit amount, price per weight, and SKU, and any combination thereof.

16. The merchandising system of claim 1 wherein at least a first shelf of a flippable column is adapted to hold items having a first shape or a first size, and at least a second shelf of another flippable column is adapted to hold items having a second shape or second size, the first shape different from the second shape, or the first size different from the second size, or the first shape and the first size different from the second shape and second size.

17. The merchandising system of claim 1, wherein the merchandising system comprises a storage area that is separate from the flippable columns.

18. The merchandising system of claim 14, wherein the item stop flexes outwardly when an item is removed from the front of the shelf, and flexes back to its original position after said removal.

19. The merchandising system of claim 18, wherein a floor of the shelf comprises a cut away portion at the front of the shelf to allow easier removal of an item from the shelf.

20. A merchandising system comprising:

a front, a back area, a swing door located at the front, the swing door moveable about an axis between a closed position and an open position, and a lead flippable column having a first side and a second side, the first and second sides of the lead flippable column parallel to each other and extending from the front to the back area, a non-flippable column stop located at a side of the merchandising system opposite the swing door, and at least one non-lead flippable column, wherein the lead flippable column is positioned between the swing door and the non-lead flippable column, the first side of the lead flippable column closer to the swing door than the second side of the lead flippable column, the second side of the lead flippable column closer to the non-lead flippable column than the first side of the lead flippable column, the flippable column and the non-lead flippable column each comprising a plurality of shelves, the shelves in the flippable column and the non-lead flippable column extending from the front to the back area, each shelf configured to support a single row of items, and wherein the first side of the lead flippable column at the back area is non-accessible from the front when the swing door is in the closed position, and is accessible from the front when the swing door is in the open position.

21. The merchandising system of claim 20, wherein the non-flippable column stop comprises a storage area that is separate from the flippable columns.

22. An apparatus comprising:

a shelf, the shelf comprising side rails and a bottom, the shelf configured to support a single row of items between the side rails; and an item stop located at the front of the shelf, wherein the item stop flexes outwardly when an item is removed from the front of the shelf, and flexes back to its original position after said removal.

23. The apparatus of claim 22, wherein a floor of the shelf comprises a cut away portion at the front of the shelf.

24. The apparatus of claim 22 adapted to store packages of yogurt on the shelf.

25. The apparatus of claim 22, wherein the item stop comprises a front face having a designated portion, the designated portion comprising item information selected from the group consisting of price, unit amount, price per weight, and SKU, and any combination thereof.

26. The apparatus of claim 25, wherein the front face comprises a transparent portion that is not covered by the designated area.

27. The apparatus of claim 22, wherein the item stop comprises a first portion and a second portion, wherein the second portion is attached to a side rail of the shelf, wherein the second portion flexes outwardly from the side rail when an item is removed from the shelf, and flexes back to its original position after said removal, the first portion remaining stationary during said removal.

28. The apparatus of claim 27, wherein the second portion is connected to the side rail by a hinge, and the second portion flexes via the hinge during said removal of an item.

29. The apparatus of claim 28, wherein the second portion comprises a curved portion and a connecting portion, the connecting portion attached to the hinge.

30. The apparatus of claim 29, wherein the first portion of the item stop comprises a designated portion, the designated portion comprising item information selected from the group consisting of price, unit amount, price per weight, and SKU, and any combination thereof.

31. An apparatus comprising:

a shelf, the shelf comprising side rails and a bottom, the shelf configured to support a single row of items between the side rails; and an item stop located at the front of the shelf, wherein the bottom of the shelf comprises a front bottom portion and a back bottom portion, the front bottom portion closer to the item stop than the back bottom portion, each bottom portion having a downward slope towards the item stop, the front bottom portion having a downward slope that is greater than the downward slope of the back bottom portion.

* * * * *